US006389970B1

(12) United States Patent
Tashiro et al.

(10) Patent No.: US 6,389,970 B1
(45) Date of Patent: May 21, 2002

(54) DIRECT DRAWING TYPE LITHOGRAPHIC PRINTING PLATE PRECURSOR AND METHOD FOR PRODUCING LITHOGRAPHIC PRINTING PLATE USING THE SAME

(75) Inventors: Hiroshi Tashiro; Eiichi Kato, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 70 days.

(21) Appl. No.: 09/583,669

(22) Filed: May 31, 2000

(30) Foreign Application Priority Data

May 31, 1999 (JP) ..... 11-152863
May 31, 1999 (JP) ..... 11-152864

(51) Int. Cl.[7] ..... B41C 1/10
(52) U.S. Cl. ..... 101/462; 101/465
(58) Field of Search ..... 101/457, 462, 101/463.1, 465, 466, 401.1; 428/195, 328, 511; 430/271.1, 302, 49

(56) References Cited

U.S. PATENT DOCUMENTS 2,297,691 A * 10/1942 Carlson ..... 430/55
2,899,335 A * 8/1959 Straughham ..... 430/119
3,247,290 A * 4/1966 Werkman ..... 525/197
3,411,908 A * 11/1968 Crawford ..... 430/503
4,606,989 A * 8/1986 Uytterhoeven ..... 430/106
4,729,310 A * 3/1988 Love, III ..... 101/157
4,833,486 A * 5/1989 Zerillo ..... 346/1.1
4,970,130 A * 11/1990 Tam ..... 430/41
5,153,618 A * 10/1992 Frank ..... 346/159
5,424,155 A * 6/1995 Nakayama ..... 430/49
5,561,014 A * 10/1996 Kato ..... 430/49
5,852,975 A * 12/1998 Miyabe et al. ..... 101/463.1
6,120,655 A 9/2000 Ishii et al. ..... 101/463.1

* cited by examiner

*Primary Examiner*—Stephen R. Funk
(74) *Attorney, Agent, or Firm*—Reed Smith LLP

(57) ABSTRACT

A direct drawing lithographic printing plate precursor, which includes a water-resisting support having provided thereon an image-receiving layer, an image being formed on the image-receiving layer with an oil-based ink by an electrostatic ink jet system, wherein the water-resisting support has at least a resin coating layer on the side opposite to the side on which the image-receiving layer is provided, wherein the resin coating layer includes a mixture containing from 10 to 90 wt % of a low density polyethylene having a density of from 0.915 to 0.930 g/ml and a melt index of from 1.0 to 30.0 g/10 min., wherein the surface of the resin coating layer has a Bekk's smoothness of from 5 to 2,000 sec/10 ml, and wherein the water-resisting support has a conductive layer having a specific electric resistance value of $10^{10}$ Ω cm or less on the image-receiving layer side surface thereof and on at least one end face thereof. Also disclosed is a method for preparing a direct drawing lithographic printing plate using the printing plate precursor.

9 Claims, 4 Drawing Sheets

DIRECT DRAWING TYPE LITHOGRAPHIC PRINTING PLATE PRECURSOR AND METHOD FOR PRODUCING LITHOGRAPHIC PRINTING PLATE USING THE SAME

FIELD OF THE INVENTION

The present invention relates to a novel direct drawing type lithographic printing plate precursor and a method for producing a lithographic printing plate using the same, and more specifically to a method for producing a lithographic printing plate using oil-based ink for ink jet recording and superior in plate-making quality and printed image quality.

BACKGROUND OF THE INVENTION

With the development of office appliances and the expansion of office automation in recent years, it has been prevalent in the field of small-scale printing to adopt an offset printing system utilizing various means for plate-making, i.e., for image-forming on a direct drawing type lithographic printing plate precursor having an image-receiving layer provided on a water-resisting support to thereby produce a printing plate.

Conventional direct drawing type lithographic printing plate precursors comprise a water-resisting support having provided thereon an image-receiving layer, and a lipophilic image is formed on such a direct drawing type lithographic printing plate precursor with oil-based ink by means of a typewriter or handwriting, or a lipophilic image is formed by heat-fusion transferring an image from an ink ribbon with a heat transfer printer and, if necessary, performing hydrophilization treatment of a non-image area, to thereby obtain a printing plate.

However, since the printing plate produced by this method is insufficient in mechanical strength of the image area, peeling off of the image area may occur during printing.

Further, plate-making of the above-described direct drawing type lithographic printing plate precursor by an ink jet printer is performed, wherein water base ink with water as a dispersion medium is used, but this technique has a drawback in that the water base ink oozes from the image on the printing plate and the drawing rate lowers since it takes time to dry the ink. To alleviate this problem, a method of using oil-based ink where a non-water base dispersion medium is used is disclosed in JP-A-54-117203 (the term "JP-A" as used herein means an "unexamined published Japanese patent application").

However, since the ink is ejected from a thin nozzle in this method, clogging may occur at the discharge part.

SUMMARY OF THE INVENTION

The present invention has been completed to solve the above-described problems and an object of the present invention is to provide a direct drawing type lithographic printing plate precursor capable of providing a large number of prints having clear images.

Other objects and effects of the present invention will become apparent from the following description.

The above objects of the present invention have been achieved by providing the following lithographic printing plate precursors (1) to (8) and printing plate preparation method (9).

(1) A direct drawing lithographic printing plate precursor, which comprises a water-resisting support having provided thereon an image-receiving layer, an image being formed on the image-receiving layer with an oil-based ink by an electrostatic ink jet system, wherein said water-resisting support has at least a resin coating layer on the side opposite to the side on which the image-receiving layer is provided, wherein said resin coating layer comprises a mixture containing from 10 to 90 wt % of a low density polyethylene having a density of from 0.95 to 0.930 g/ml and a melt index of from 1.0 to 30.0 g/10 min., and from 10 to 90 wt % of a high density polyethylene having a density of from 0.940 to 0.970 g/ml and a melt index of from 1.0 to 30.0 g/10 min., wherein the surface of said resin coating layer has a Bekk's smoothness of from 5 to 2,000 sec/10 ml, and wherein said water-resisting support has a conductive layer having a specific electric resistance value of $10^{10}$ Ω·cm or less on the image-receiving layer side surface thereof and on at least one end face thereof.

(2) The direct drawing lithographic printing plate precursor according to the above (1), wherein said image-receiving layer is formed from a dispersion comprising:

an inorganic pigment comprising silica particles having an average particle diameter of from 1 to 6 μm and ultra-fine particles of inorganic pigment having an average particle diameter of from 5 to 50 nm, at a weight ratio of from 40/60 to 70/30; and at least one hydrophilic resin modified with a silyl functional group represented by the following formula (I):

$$—Si(R)_n(OX)_{3-n} \quad (I)$$

wherein R represents a hydrogen atom or a hydrocarbon group having from 1 to 12 carbon atoms; X represents an aliphatic group having from 1 to 12 carbon atoms; and n represents 0, 1 or 2.

(3) The direct drawing lithographic printing plate precursor according to the above (2), wherein said dispersion further contains gelatin and a gelatin-hardening compound.

(4) The direct drawing lithographic printing plate precursor according to the above (2), wherein the colloidal ultra-fine particles of inorganic pigment having an average particle diameter of from 5 to 50 nm comprise at least one member selected from colloidal silica, titania sol and alumina sol.

(5) The direct drawing lithographic printing plate precursor according to the above (3), wherein the gelatin-hardening compound is a compound having in its molecule at least two double bond groups represented by the following formula (II):

$$CH_2{=}CH—W— \quad (II)$$

wherein W represents $—OSO_2—$, $—SO_2—$, $—CONR^1—$ or $—SO_2NR^1—$ (wherein $R^1$ represents a hydrogen atom or an aliphatic group having from 1 to 8 carbon atoms).

(6) The direct drawing lithographic printing plate precursor according to the above (1), wherein said image-receiving layer contains:

at least one kind of particles having an average particle diameter of from 0.01 to 5 μm and comprising atoms having interatomic ionic bonding rate of Pauling of the compound of 0.2 or more, which particle being selected from hydrous metallic compounds, metallic oxides and double oxides; and a binder resin containing a complex comprising: a resin having a siloxane bond connected with Si via an oxygen atom; and an organic polymer containing a group capable of bonding with said resin via hydrogen bonding.

(7) The direct drawing lithographic printing plate precursor according to the above (6), wherein said resin containing siloxane bond is a polymer obtained by hydrolysis polycondensation of at least one silane compound represented by the following formula (III):

$$(R^0)_m Si(Y)_{4-m} \quad \text{(III)}$$

wherein $R^0$ represents a hydrogen atom, a hydrocarbon group or a heterocyclic group; Y represents a hydrogen atom, a halogen atom, —$OR^2$, —$OCOR^3$, or —$N(R^4)(R^5)$ (wherein $R^2$ and $R^3$ each represents a hydrocarbon group, and $R^4$ and $R^5$, which may be the same or different, each represents a hydrogen atom or a hydrocarbon group); and m represents 0, 1 or 2, provided that the case in which Si atom is bonded to three hydrogen atoms is excluded.

(8) The direct drawing lithographic printing plate precursor according to the above (1), wherein said image-receiving layer has a surface smoothness of 30 sec/10 ml or more in terms of Bekk's smoothness.

(9) A method for preparing a direct drawing lithographic printing plate, which comprises:

ejecting an oil-based ink by an electrostatic ink jet recording system onto an image-receiving layer of a direct drawing lithographic printing plate precursor according to the above (1) to form an image thereon, wherein said oil-based ink is a dispersion comprising:

a non-aqueous solvent having an electric resistance of $10^9$ Ω·cm or more and a dielectric constant of 3.5 or less as a dispersion medium; and hydrophobic charged resin particles, which are solid at least at normal temperature, dispersed in the non-aqueous solvent.

BRIEF DESCRIPTION OF THE ACCOMPANYING DRAWINGS

Figure 1:
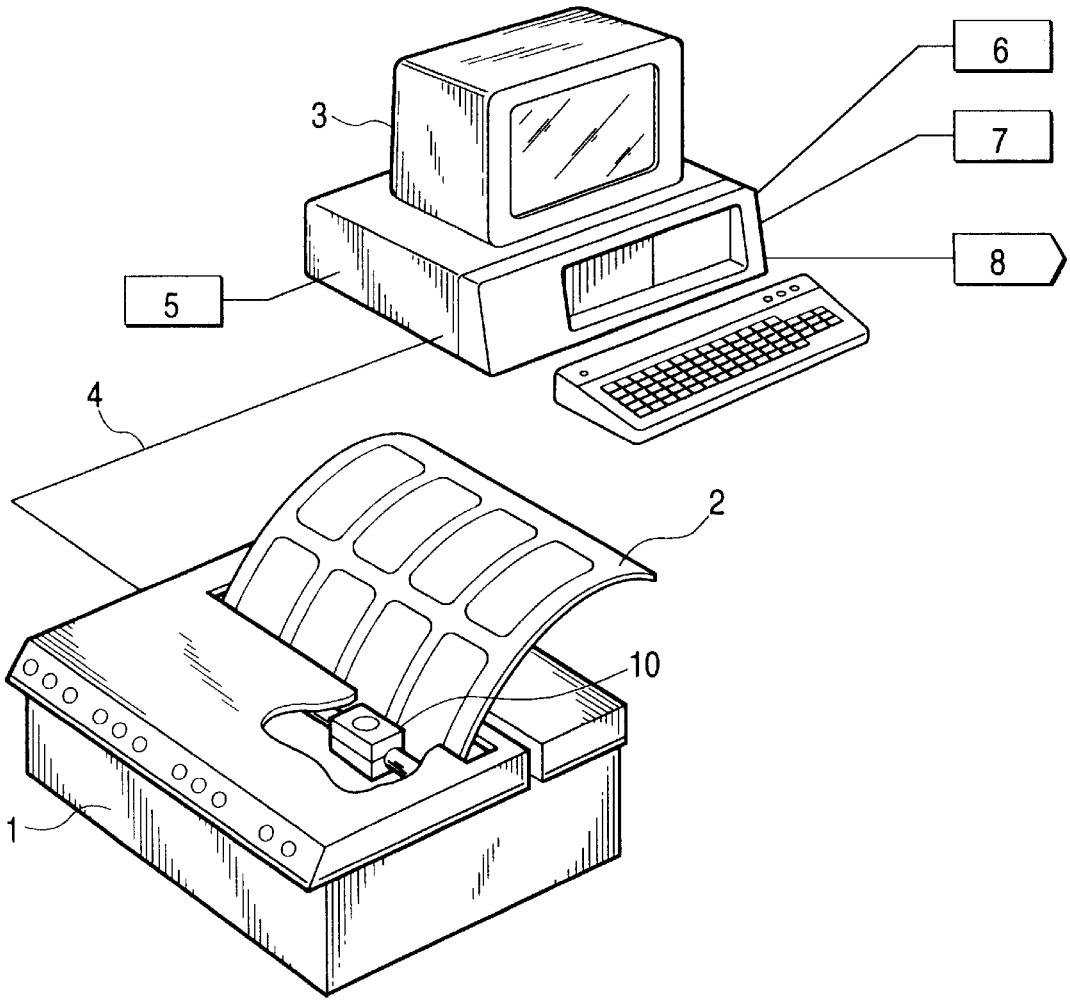
FIG. 1 is a schematic view showing an example of an apparatus system for use in the present intention.

In these figures, the numerals denote the following members, respectively.

1: Ink jet recording apparatus
2: Master
3: Computer
4: Bus
5: Video camera
6: Hard disk
7: Floppy disk
8: Mouse
10: Head
10*a*: Ejection slit
10*b*: Ejection electrode
10*c*: Counter electrode
11: Oil-based ink
101: Upper unit
102: Lower unit
13: Head for ink jet recording
14: Head body
15, 16: Meniscus regulating plates
17: Ejection electrode
18: Groove for ink
19: Separator wall
20, 20': Ejection part
21: Separator wall
22: Tip part of separator wall

DETAILED DESCRIPTION OF THE INVENTION

The present invention will be described in detail below.

The direct drawing lithographic printing plate precursor according to the present invention provides an image by an ink jet method ejecting oil-based ink on the image-receiving layer provided on a water-resisting support by an electrostatic field, and the lithographic printing plate obtained according to the present invention can provide a large number of prints having clear images.

In contrast to the present invention, the technique disclosed in JP-A-54-117203 is a system of ejecting ink by pressure, thus a precise image cannot be obtained, although it utilizes oil-based ink and an ink jet method similar to the present invention. Further, as the image-receiver, the foregoing technique uses an aluminum plate for the PS plate but aluminum is expensive and requires a large-scale apparatus for handling.

It is preferred that the water-resisting support be electrically conductive, especially at least the part between the image-receiving layer and the substrate of the water-resisting support. Further, at least the end face of one side of the water-resisting support has a specific electric resistance value of $10^{10}$ Ω·cm or less. The specific electric resistance value is more preferably $10^8$ Ω·cm or less, and the value may be infinitely near zero.

The electric conductivity as described above can be imparted to the support in the part just under the image-receiving layer, e.g., by covering a substrate, such as paper or film, with a layer comprising an electrically conductive filler, such as carbon black, and a binder, by sticking a metal foil on a substrate, or by vapor depositing a metal onto a substrate, In the above range of electric conductivity, the charged ink droplets just after attaching to the image-receiving layer can quickly lose their electric charge through earth. Thus, clear images free from disorder can be formed.

In the present invention, the specific electric resistance value (also referred to as "a volume specific electric resistance value" or "specific electric resistance value") is measured by a three terminal method with providing guard electrode according to the method described in JIS K-6911.

It is preferable to use a base paper having a thickness of from 50 to 200 μm as the water-resisting support. At a thickness in this range, sufficient strength as well as good handling can be obtained. The thickness of the polyethylene resin to be covered is appropriately from 5 to 50 μm. At a thickness in this range, a base paper can be provided with a sufficient waterproofing property and an excellent water-resisting property can be obtained followed by few economical problems. The thickness is more preferably from 10 to 30 $\mu$m.

In the present invention, the water absorption property of the water-resisting support is preferably 0.1 g/m$^2$ (45 minute value) or less, more preferably 0.05 g/m$^2$ (45 minute value) or less, in cup water absorption measured by cup water absorption test using the surface of the water-resisting support covered with a resin. The water absorption is preferably 0 but, in general, the lower limit thereof is 0.001 g/m$^2$ or so. Further, the water absorption property of the water-resisting support which is not covered with a resin is preferably 3.0 g/m$^2$ (45 minute value) or less, more preferably 2.5 g/m$^2$ (45 minute value) or less, in cup water absorption.

In the above range of water absorption of the water-resisting support, the osmosis of a dampening solution to the support during printing can be effectively suppressed without causing the extension and cutting of the plate and, for example, the press life capable of printing 7,000 sheets or more can be accomplished.

Cup water absorption measured by cup water absorption test is described in JIS P8140. This method is performed by inserting a test piece between a metal ring having an extremely smooth bottom (inside diameter: 112.8 mm, area: 100 cm$^2$, height: 25 mm, thickness: 6 mm) and a base plate, sufficiently clamping the test piece, then filling the inside of the ring with 50 ml of distilled water, and measuring the water absorption weight of the test piece in 'specific time and expressing the weight by g/m$^2$.

The water-resisting support at least one surface of which is laminated with a polyethylene resin for use in the present invention will be described below.

At least one side of base paper is covered with polyethylene, in general, by extrusion lamination, which makes it possible to obtain a printing plate material capable of preparing a lithographic printing plate having excellent image quality and press life. The extrusion lamination method includes the steps of melting polyolefin, forming the molten resin into a film, pressing the film immediately against base paper and then cooling the film, and various well-known apparatuses can be used for extrusion lamination.

The present inventors have found that the uniformity of coating film at extrusion lamination and a polyethylene layer having excellent heat resistance can be obtained by using the mixture of a low density polyethylene and a high density polyethylene.

When a low density polyethylene is used alone, although the uniformity of coating film at extrusion lamination can be obtained, heat resistance is not sufficient since the melting point is low, which causes subsequent failures. That is, one such failure is that the drying temperature of 100° C. or more is necessary when an image-receiving layer is coated, and the polyethylene layer softens at that time and adheres to a pass roll, and another is that the polyethylene layer also softens during the process of heating stabilization of the ink image in plate-making, and accelerates the generation of blisters between the polyethylene layer and the base paper caused by the volatile content (water content) in the base paper.

On the other hand, when a high density polyethylene is used alone, although the above failure can be solved, the coating film at extrusion lamination becomes not uniform and the unevenness of the adhesion with the base paper becomes large, thus the resulting product is impracticable. The present inventors have found that the above problems can be solved at a stroke by appropriately mixing both.

As the low density polyethylene, those having a density of from 0.915 to 0.930 g/ml, a melt index of from 1.0 to 30 g/10 min. are preferably used, and as the high density polyethylene, those having a density of from 0.940 to 0.970 g/ml, a melt index of from 1.0 to 30 g/10 min. are preferred. The blending ratio of the low density polyethylene to the high density polyethylene is preferably from 10/90 to 90/10 by weight ratio. When the low density polyethylene is less than 10 wt %, extrusion coating film is not uniform and normal lamination cannot be effected, while when the high density polyethylene is less than 10 wt %, satisfactory heat resistance cannot be obtained.

For increasing the adhesion strength of the base paper and the polyethylene layer, it is preferred to coat on the base paper in advance polyethylene derivatives such as ethylene-vinyl acetate copolymers, ethylene-acrylate copolymers, ethylene-methacrylate copolymers, ethylene-acrylic acid copolymers, ethylene-methacrylic acid copolymers, ethylene-acrylonitrile-acrylic acid copolymers, or ethylene-acrylonitrile-methacrylic acid copolymers, or it is also preferred that the surface of the base paper is subjected to corona discharge treatment. Alternatively, the base paper can be surface-treated according to the methods disclosed in JP-A-49-24126, JP-A-52-36176, JP-A-52-121683, JP-A-53-2612, JP-A-54-111331 and JP-B-51-25337 (the term "JP-B" as used herein means an "examined Japanese patent publication").

Examples of paper which can be used as the base paper for preparing a printing plate precursor include wood pulp paper, synthetic pulp paper, and paper made of a mixture of wood pulp and synthetic pulp.

In the present invention, the surface smoothness of the side of the water-resisting support coated with a resin opposite to the side on which an image-receiving layer is coated is from 5 to 2,000 (sec/10 ml), preferably from 50 to 1,500 (sec/10 ml), and more preferably from 100 to 500 (sec/10 ml), in terms of Bekk's smoothness. In the above range, it is thought that the distortion of the printing plate imposed at printing time, e.g., the distortion of the plate caused by the friction with a blanket during printing, can be prevented, as a result the printing dimension and accuracy can be maintained. This is presumably because the frictional resistance between the printing plate and the printing cylinder of a printer is one big factor of the distortion.

Further, in the present invention, by controlling the Bekk's smoothness of the surface of the support which is in contact with the image-receiving layer to 300 (sec/10 ml) or more, the image reproducibility and press life can further be improved. As such improving effects can be obtained even when the image-receiving layer having the same surface smoothness is used, the increase in the smoothness of the support surface is considered to increase the adhesion between the image area and the image-receiving layer.

Bekk's smoothness can be measured by a Bekk's smoothness tester. The Bekk's smoothness tester is a tester for measuring the time required for a definite amount of air (10 ml) to pass through between a test piece and a glass surface under a reduced pressure, wherein the test piece is pressed at a definite pressure (1 kg/cm$^2$) against a highly smooth finished circular glass plate having a hole at its center.

The oil-based ink for use in the present invention is a dispersion comprising hydrophobic resin particles, which are solid at least at a normal temperature (i.e., from 15 to 35° C.), dispersed in a non-aqueous solvent preferably having an electric resistance of $10^9$ Ω·cm or more and a dielectric constant of 3.5 or less as a dispersion medium. By using such a non-aqueous solvent as a dispersion medium, the electric resistance of the oil-based ink is properly controlled, and thus the ejection of the oil-based ink by the action of an electrical field can be affected and as a result the image quality is improved. In addition, the use of the above-described resin particles enhances the affinity with the image-receiving layer and as a result, high quality images can be obtained and the press life of the resulting printing plate is improved.

The plate-making method according to the present invention will be described below.

In the first place, the water-resisting support having conductivity for use in the present invention will be explained below.

The support which is conductive as a whole can be obtained by using a conductive base paper, e.g., paper impregnated with sodium chloride, as a substrate, and providing a water-resisting conductive layer at least on one side of the substrate.

A conductive layer can be formed by coating a layer containing a conductive filler and a binder at least on one side, further at least on the end face of one side of the water-resisting support. The thickness of the conductive layer to be coated is preferably from 0.5 to 20 μm. Here, "the end face of one side of the water-resisting support" means the plane vertical to the plane on which the image-receiving layer is coated, preferably, when the water-resisting support is used as a plate material, light and left vertical planes with facing the plate-making direction.

In the present invention, by providing the above conductive layer on at least one end face of the water-resisting support, when recording is performed with a laser printer or an ink jet system, earthing of the conductive layer is easy even if the side opposite to the side on which the image-receiving layer is provided is coated with a polyethylene resin layer (an insulating layer) according to the present invention, as a result, the recording property of the image toner (density, sharpness) increases and the press life is improved. Accordingly, the above conductive layer is sufficient to be provided on one side of the water-resisting support, however, if it is provided on both end faces, more effective earthing becomes possible and recording quality of images and the press life are further improved.

Examples of the conductive fillers usable include granular carbon black, graphite, metal powder such as silver, copper, and nickel, tin oxide powder, flaky aluminum or nickel, fibrous carbon, brass, aluminum, copper, and stainless steel.

On the other hand, the binder can be appropriately selected from various kinds of resins. Specific examples of resins suitable for the binder include hydrophobic resin, e.g., acrylic resins, vinyl chloride resins, styrene resins, styrene-butadiene resins, styrene-acrylic resins, urethane resins, vinylidene chloride resins and vinyl acetate resins, and hydrophilic resins, e.g., polyvinyl alcohol resins, cellulose derivatives, starch and derivatives thereof, polyacrylamide resins and copolymers of styrene and maleic anhydride.

Another method for forming the conductive layer is to laminate a conductive thin film. Examples of the conductive thin film usable include a metal foil and a conductive plastic film. More specifically, an aluminum foil can be used for the metal foil, and a polyethylene resin in which carbon black is incorporated can be used as the laminating material for the conductive plastic film. Both hard and soft aluminum foils can be used as the laminating material. The thickness of the conductive thin film is preferably from 0.5 to 20 μm.

For the lamination of a polyethylene resin in which carbon black is incorporated, it is preferred to adopt an extrusion lamination method. The extrusion lamination method includes the steps of melting polyolefin by heating, forming the molten resin into a film, pressing the film immediately against base paper and then cooling the film, and various well-known apparatuses can be used for extrusion lamination. The thickness of the laminated layer is preferably from 10 to 30 μm. Carbon black may be incorporated to the polyethylene-coated layer of the present invention and the layer may serve also as a conductive layer.

As another example of a support which is conductive as a whole, a conductive plastic film and a metal plate can be used as they are so long that they have a satisfactory water resisting property.

Examples of the conductive plastic films include, e.g., polypropylene and polyester films to which a conductive filler such as carbon fiber or carbon black s incorporated, and the metal plate includes, e.g, an aluminum plate. The thickness of a substrate is preferably from 80 to 200 μm. When the substrate has a thickness of less than 80 μm, sufficient strength cannot be ensured, while when the thickness of the substrate exceeds 200 μm, the handling property such as transportability in a recording apparatus may tend to decrease.

The provision of the layer having conductivity is described.

As the water-resisting substrate on which the conductive layer is provided, paper subjected to water-resisting treatment, paper laminated with a plastic film or a metal foil, and a plastic film each preferably having a thickness of from 80 to 200 μm can be used.

As a method for forming a conductive layer on the substrate, the same methods as described above in the case where the entire of the support is conductive can be used. Specifically, the composition containing a conductive filler and a binder is applied to one side of the substrate to form a layer having a thickness of from 0.5 to 20 μm, or the conductive layer is formed by laminating a metal foil or a conductive plastic film on the substrate.

As the method other than the above methods, e.g., a metal film such as an aluminum, tin, palladium or gold film may be deposited on a plastic film.

Thus, a conductive water-resisting support having specific electric resistance of $10^{10}$ Ω·cm or less can be obtained.

Further, an interlayer may be provided just under the image-receiving layer. The interlayer is not particularly limited and any layer may be used so long as it has good adhesion property to both the image-receiving layer and the layer just under the interlayer. The interlayer preferably has a thickness of from 0.5 to 10 μm. Various kinds of resins and dispersions comprising these resins and inorganic particles are appropriately selected and used as the materials of the interlayer.

Specifically, as inorganic pigments, e.g, kaoline, clay, talc, calcium carbonate, silica, titanium oxide, zinc oxide, barium sulfate, alumina, iron hydroxide, aluminum hydroxide, titanium oxide hydrate, zinc oxide hydrate, etc., can be exemplified.

As the above resins, various resins are arbitrarily selected. Specifically, the examples of the resins include olefin homopolymers and copolymers (e.g., polyethylene, polypropylene, polyisobutylene, ethylene-vinyl acetate copolymer, ethylene-acrylate copolymer, ethylene-methacrylate copolymer, ethylenemethacrylic acid copolymer, etc.), vinyl chloride copolymers (e.g., polyvinyl chloride, vinyl chloride-vinyl acetate copolymer, etc.), vinylidene chloride copolymers, vinyl alcanate homopolymers and copolymers, allyl alcanate homopolymers and copolymers, homopolymers and copolymers of styrene and derivatives thereof (e.g., butadiene-styrene copolymer, isoprene-styrene copolymer, styrene-methacrylate copolymer, styrene-acrylate copolymer, etc.), acrylonitrile copolymers, methacrylonitrile copolymers, alkyl-vinyl ether copolymers, acrylate homopolymers and copolymers, methacrylate homopolymers and copolymers, diitaconate homopolymers and copolymers, maleic anhydride copolymers, acrylamide copolymers, methacrylamide copolymers, phenolic resins, alkyd resins, polycarbonate resins, ketone resins, polyester resins, silicon resins, amide resins, hydroxyl group- and carboxyl group-modified polyester resins, butyral resins, polyvinyl acetal resins, urethane resins, rosin resins, hydrogenated rosin resins, petroleum resins, hydrogenated petroleum resins, maleic resins, terpene resins, hydrogenated terpene resins, chroman-indene resins, cyclized rubber-methacrylate copolymers, cyclized rubber-acrylate copolymers, copolymers containing a heterocyclic ring not containing a nitrogen atom (examples of the heterocyclic rings include, e.g., a furan ring, a tetrahydrofuran ring, a thiophene ring, a dioxane ring, a dioxofuran ring, a lactone ring, a benzofuran ring, a benzothiophene ring, a 1,3-dioxetane ring, etc.), and expoxy resins.

Specific examples of the natural and semisynthetic polymers include cellulose, cellulose derivatives (e.g., cellulose esters such as cellulose nitrate, cellulose sulfate, cellulose acetate, cellulose propionate, cellulose succinate, cellulose butyrate, cellulose acetate succinate, cellulose acetate butyrate, cellulose acetate phthalate; and cellulose ethers such as methyl cellulose, ethyl cellulose, cyanoethyl cellulose, carboxymethyl cellulose, hydroxyethyl cellulose, hydroxypropyl cellulose, ethylhydroxyethyl cellulose, hydroxypropylmethyl cellulose, carboxymethylhydroxyethyl cellulose, etc.), starch, starch derivatives (e.g., oxidized starch, esterified starches including those esterified with an acid such as nitric acid, sulfuric acid, phosphoric acid, acetic acid, propionic acid, butyric acid, or succinic acid; and etherified starches such as methylated starch, ethylated starch, cyanoethylated starch, hydroxyalkylated starch, or carboxymethylated starch), alginic acid, pectin, carrageenan, tamarind gum, natural rubbers (e.g., gum arabic, guar gum, locust bean gum, tragacanth gum, xanthane gum, etc.), pullulan, dextran, casein, gelatin, chitin, and chitosan.

Examples of the synthetic polymers include polyvinyl alcohol, polyalkylene glycol (e.g., polyethylene glycol, polypropylene glycol, ethylene glycol-propylene glycol copolymers, etc.), allyl alcohol copolymers, homopolymers or copolymers of acrylate or methacrylate containing at least one hydroxyl group (examples of ester substituents include, e.g., a 2-hydroxyethyl group, a 3-hydroxypropyl group, a 2,3-dihydroxypropyl group, a 3-hydroxy-2-hydroxymethyl-2-methyl-propyl group, a 3-hydroxy-2,2-di(hydroxymethyl) propyl group, a polyoxyethylene group, a polyoxypropylene group, etc.), and homopolymers or copolymers of N-substituted acrylamide or methacrylamide (examples of N-substituents include, e.g., a monomethylol group, a 2-hydroxyethyl group, a 3-hydroxypropyl group, a 1,1-bis (hydroxymethyl)ethyl group, a 2,3,4,5,6-pentahydroxypentyl group, etc.).

The compounding ratio of the inorganic particles to the resins in the above interlayer is preferably from 1/99 (wt %) to 90/10 (wt %), more preferably from 5/95 to 70/30 (wt %).

The above interlayer surface preferably has a surface smoothness of 100 (sec/10 ml) or more, preferably 500 (sec/10 ml) or more, in terms of Bekk's smoothness. At a surface smoothness in this range, the property of coating on the interlayer and the adhesion to the layer are improved.

For further improving water resistance and film strength, a crosslinking agent way be added to the interlayer.

Compounds conventionally used as crosslinking agents can be used in the present invention. Specifically, the compounds described in Shinzo Yamashita and Tosuke Kaneko compiled, *Kakyozai Handbook* (*Handbook of Crosslinking Agents*), Taiseisha Co. (1981), Kobunshi Gakkai compiled, *Kobunshi Data Handbook—Kisohen* (*Polymer Data Handbook—Fundamental Course*), Baifukan Co. (1986) can be used as the crosslinking agent in the present invention.

Examples of the crosslinking agents which can be used in the present invention include ammonium chloride, metallic ions, organic peroxides, polyisocyanate compounds (e.g., toluylene diisocyanate, diphenylmethane diisocyanate, triphenylmethane triisocyanate, polymethylene phenylisocyanate, hexamethylene diisocyanate, isophorone diisocyanate, high molecular polyisocyanate, etc.), polyol compounds (e.g., 1,4-butanediol, polyoxypropylene glycol, polyoxyethylene glycol, 1,1,1-trimethylolpropane, etc.), polyamine compounds (e.g., ethylenediamine, γ-hydroxypropylated ethylenediamine, phenylenediamine, hexamethylenediamine, N-aminoethylpiperazine, modified aliphatic polyamines, etc.), polyepoxy group-containing compounds and epoxy resins (e.g., compounds described in Hiroshi Kakiuchi, *Shin Epoxy Jushi* (*New Epoxy Resins*), Shokodo Co. (1985), and Kuniyuki Hashimoto, *Epoxy Jushi* (*Epoxy Resins*), Nikkan Kogyo Shinbunsha Co. (1969)), melamine resins (e.g, compounds described in Ichiro Miwa and Hideo Matsunaga, *Urea•Melamine Jushi* (*Urea•Melamine Resins*), Nikkan Kogyo Shinbunsha Co. (1969)), and poly(meth)acrylate compounds (e.g., compounds described in Makoto Ogawara, Takeo Saegusa and Toshinobu Higashimura, *Oligomer* (*Oligomers*), Kodansha Co. (1976), and Eizo Omori, *Kino-sei Acryl-kei Jushi* (*Functional Acrylic resins*), Techno System Co. (1985)).

An image-receiving layer is provided on the water-resisting support. The thickness of the image-receiving layer to be provided is preferably from 5 to 30 μm.

The image-receiving layer according to the present invention preferably has surface smoothness of 30 (sec/10 ml) or more in terms of Bekk's smoothness. Further, the preferred ranges of surface smoothness are varied depending on the toner used in an electrophotographic printer employed for plate-making, e.g., a dry toner or a liquid toner.

In an electrophotographic printer with a dry toner, the surface smoothness of the image-receiving layer of the printing plate precursor according to the present invention is preferably from 30 to 200 (sec/10 ml), more preferably from 50 to 150 (sec/10 ml). At a surface smoothness in this range, the adhesion of the scattered toner to the non-image area (which causes background stain) can be prevented and the adhesion of the toner to the image-receiving layer in the image area is uniformly and sufficiently affected during the steps of transfer and fixing of the toner image on the printing plate precursor and a result, the reproducibility of fine lines and fine letters and the uniformity of solid image parts are improved.

On the other hand, in an electrophotographic printer with a liquid toner, the surface smoothness of the image-receiving layer of the present invention is generally 30 (sec/10 ml) or more, and the higher smoothness is preferred. Preferably it is from 150 to 3,000 (sec/10 ml), more preferably from 200 to 2,500 (sec/10 ml).

In an ink jet printer and a heat-sensitive transfer type printer, the range of the surface smoothness of the image-receiving layer is preferably the same range as in the case of using an electrophotographic printer with a liquid toner.

In this range, highly accurate toner images such as fine lines, fine letters and dot images are faithfully transferred to and formed on the image-receiving layer and the toner images adhere sufficiently firmly to the image-receiving layer to maintain image strength.

Bekk's smoothness can be measured by a Bekk's smoothness tester. The Bekk's smoothness tester is a tester for measuring the time required for a definite amount of air (10 ml) to pass through between a test piece and a glass surface under a reduced pressure, wherein the test piece is pressed at a definite pressure (1 kg/cm$^2$) against a highly smoothly finished circular glass plate having a hole at its center.

When the image-receiving layer is provided on the polyethylene laminated layer of the water-resisting support, it is preferred for the surface of the polyethylene laminated layer to be subjected to surface treatment, such as corona discharge treatment, glow discharge treatment, flame treatment, UV ray treatment, ozone treatment, or plasma treatment, with a view to improving the adhesion of the polyethylene laminated layer to the image-receiving layer. The thickness of the thus-produced image-receiving layer is preferably from 5 to 30 $\mu$m.

As the image-receiving layer, a hydrophilic layer comprising an inorganic pigment and a binder, or a layer capable of becoming hydrophilic by desensitization treatment can be used in the present invention.

One preferred embodiment of the image-receiving layer for use in the present invention is an image-receiving layer formed from a dispersion containing a specific inorganic pigment and a hydrophilic resin modified with the specific silyl functional group as the main components.

The inorganic pigment preferably comprises silica particles having an average particle diameter of from 1 to 6 $\mu$m and ultra-fine particles of inorganic pigment having an average particle diameter of from 5 to 50 nm.

The silica particles for use in the present invention preferably have an average particle diameter of from 1.0 to 4.5 $\mu$m. The silica particles are finely divided amorphous synthetic silica powder comprising silica dioxide as a main component (99% or more) and having no crystalline structure. Such silica particles are specifically described, e.g., in Toshiro Kagami and Akira Hayashi supervised, *Kojundo Silica no Oyogijutsu* (*Applied Technology of High Purity Silica*), Chapters 4 and 5, CMC Publishing Co. (1991).

The finely divided synthetic silica powder according to the present invention has a well-controlled porosity and pore volume and an average particle diameter of from 1 to 6 $\mu$m. However, the pore diameter, pore volume, oil absorption amount, surface silanol group density, etc, of the finely divided synthetic silica powder for use in the present invention are not specifically limited. The finely divided synthetic silica powders are easily commercially available.

As the ultra-fine particles of inorganic pigment having an average particle diameter of from 5 to 50 nm, conventionally well-known compounds can be exemplified. Preferred examples of such compounds include silica sol, titania sol, alumina sol, titanium oxide, titanium oxide hydrate, magnesium oxide, magnesium carbonate, zinc oxide, nickel oxide, zirconium oxide, etc. More preferred examples include at least one of silica sol, titania sol and alumina sol.

Silica sol is a dispersion in which ultra-fine silica particles having a particle diameter of from 1 to 100 nm and having many hydroxyl groups on the surface thereof and forming siloxane bond (—Si—O—Si—) in the inside thereof are dispersed in water or a polar solvent. The silica sol is also referred to as "colloidal silica". The silica sol is specifically described in the above *Kojundo Silica no Oyogijutsu* (*Applied Technology of High Purity Silica*), Chapter 3.

Alumina sol is an alumina hydrate (a boehmite-based compound) having a colloidal size of from 5 to 200 nm dispersed in water, in which an anion (e.g., a halogen ion such as a fluorine ion or a chlorine ion, or a carboxylate anion such as an acetate ion) functions as a stabilizer.

Titania sol means $TiO_2$ and $Ti(O)(OH)_2$ each having a colloidal size of from 5 to 500 nm and a mixture of them.

Of the colloidal fine particles described above, those having an average particle diameter of from 5 to 50 nm, preferably from 5 to 40 nm, can be preferably used in the present invention. The ultra-fine particles of inorganic pigment are easily commercially available.

The weight ratio of the silica particles to the ultra-fine particles of inorganic pigment in the present invention is from 40/60 to 70/30, preferably from 45/55 to 60/40.

By controlling each particle diameter of the silica particles and the ultra-fine particles of inorganic pigment for use in the present invention as the inorganic pigment and the weight ratio thereof in the above-described range, the resulting image-receiving layer maintains a sufficient film strength, and when the printing plate precursor obtained is subjected to plate-making using various printers, the occurrence of stain due to adhesion of toner or ink to the non-image area is suppressed on a practically acceptable level and highly accurate images such as fine lines, fine letters or small dots are clear without disappearance, distortion and blur. Further, when the printing plate is subjected to printing, the non-image area has excellent hydrophilicity and is prevented from adhesion of printing ink and, at the same time, in the image area, toner or ink firmly adheres to the image-receiving layer, thus, an excellent result that disappearance of image does not occur after a large number of sheets are printed can be obtained.

The image-receiving layer in this embodiment preferably contains as the hydrophilic resin at least a hydrophilic resin modified with a silyl functional group represented by the above formula (I).

By providing the above hydrophilic resin layer, the surface of the image-receiving layer of the present invention becomes sufficiently hydrophilic and also the adhering property of the image can be improved, as a result, the press life of the printing plate is markedly improved.

In formula (I), preferred examples of the hydrocarbon groups represented by R include an alkyl group having from 1 to 12 carbon atoms which may be substituted (e.g., methyl, ethyl, propyl, butyl, pentyl, hexyl, heptyl, octyl, nonyl, decyl, dodecyl, 2-hydroxyethyl, 2-methoxyethyl, 2-cyanoethyl, 2-ethoxyethyl, 3,6-dioxoheptyl, 3-sulfopropyl, 2-carboxyethyl, 2-methoxycarbonylethyl, 3-chloropropyl, 3-bromopropyl, 2,3-dihydroxypropyl, trifluoroethyl, etc.), an alkenyl group having from 3 to 12 carbon atoms which may be substituted (e.g., propenyl, butenyl, pentenyl, hexenyl, heptenyl, octenyl, nonenyl, decenyl, etc.), an aralkyl group having from 7 to 12 carbon atoms which may be substituted (e.g., benzyl, phenethyl, 3-phenylpropyl, chlorobenzyl, bromobenzyl, methylbenzyl, ethylbenzyl, methoxybenzyl, dimethylbenzyl, dimethoxybenzyl, carboxybenzyl, etc.), an alicyclic group having from 5 to 8 carbon atoms which may be substituted (e.g., cyclopentyl, cyclohexyl, 2-cyclohexylethyl, 2-cyclopentylethyl, etc.), and an aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, carboxyphenyl, sulfopehnyl, carboxymethylphenyl, etc.).

In formula (I), X represents an aliphatic group having from 1 to 12 carbon atoms. Preferred examples of the aliphatic groups include an alkyl group having from 1 to 8 carbon atoms which may be substituted (e.g., methyl, ethyl, propyl, butyl, pentyl, hexyl, heptyl, octyl, 2-methoxyethyl, 2-ethoxyethyl, 3-methoxypropyl, 3,6-dioxoheptyl, 2-oxobutyl, etc.), an alkenyl group having from 3 to 8 carbon atoms which may be substituted (e.g., propenyl, butenyl, pentenyl, hexenyl, heptenyl, octenyl, etc.), an aralkyl group having from 7 to 12 carbon atoms which may be substituted (e.g., benzyl, phenethyl, 3-phenylpropyl, chlorobenzyl, bromobenzyl, methylbenzyl, ethylbenzyl, methoxybenzyl, dimethylbenzyl, dimethoxybenzyl, etc.), and an alicyclic group having from 5 to 8 carbon atoms which may be substituted (e.g., cyclopentyl, cyclohexyl, cycloheptyl, cyclooctyl, etc.). X more preferably represents an alkyl group having from 1 to 4 carbon atoms which may be substituted.

In formula (I), n represents 0, 1 or 2, preferably 0 or 1.

The organic polymer containing a silyl functional group represented by formula (I) can be synthesized according to well-known methods, e.g., those described in *Hannosei Polymer no Gosei to Oyo* (*Synthesis and Application of Reactive Polymers*), CMC Publishing Co. (1989), JP-B-46-30711 and JP-A-5-32931. Specifically, the organic polymer is prepared by modifying a hydroxyl group in the polymer with a silyl functional group. The hydroxyl group-containing resin may be any of natural polymers, semisynthetic polymers and synthetic polymers, and specific examples include those described in Keiei Kaihatsu Center Publishing Division compiled, *Suiyosei Kobunshi•Mizubunsangata Jushi Sogo Gijutsu Shiryoshu* (*Water-Soluble Polymers•Aqueous Dispersion Type Resins, Collective Technical Data*, published by Keiei Kaihatsu Center Publishing Division (1981), Shinji Nagatomo, *Shin Suiyosei Polymer no Oyo to Shijo* (*New Applications and Market of Water-Soluble Polymers*), CMC Publishing Co. (1988), *Kinosei Cellulose no Kaihatsu* (*Development of Functional Cellulose*), CMC Publishing Co. (1985), and Munio Kotake supervised, *Dai Yukikagaku* (*Grand Organic Chemistry*), Vol. 19*: Tennen Kobunshi Kagobutsu* (*Natural Polymer Compounds*) *I*, Asakura Shoten Co. (1960).

Specific examples of the natural and semisynthetic polymers include cellulose, cellulose derivatives (e.g., cellulose esters such as cellulose nitrate, cellulose sulfate, cellulose acetate, cellulose propionate, cellulose succinate, cellulose butyrate, cellulose acetate succinate, cellulose acetate butyrate, cellulose acetate phthalate; and cellulose ethers such as methyl cellulose, ethyl cellulose, cyanoethyl cellulose, carboxymethyl cellulose, hydroxyethyl cellulose, hydroxypropyl cellulose, ethylhydroxyethyl cellulose, hydroxypropylmethyl cellulose, carboxymethylhydroxyethyl cellulose, etc.), starch, starch derivatives (e.g., oxidized starch, esterified starches including those esterified with an acid such as nitric acid, sulfuric acid, phosphoric acid, acetic acid, propionic acid, butyric acid, or succinic acid; and etherified starches such as methylated starch, ethylated starch, cyanoethylated starch, hydroxyalkylated starch, or carboxymethylated starch), alginic acid, pectin, carrageenan, tamarind gum, natural rubbers (e.g., gum arabic, guar gum, locust bean gum, tragacanth gum, xanthane gum, etc.), pullulan, dextran, casein, gelatin, chitin, and chitosan.

Examples of synthetic polymers include polyvinyl alcohol, polyalkylene glycol (e.g., polyethylene glycol, polypropylene glycol, ethylene glycol-propylene glycol copolymers, etc.), allyl alcohol copolymers, acrylate copolymers, methacrylate copolymers, homopolymers or copolymers of acrylate or methacrylate containing at least one hydroxyl group (examples of ester substituents include, e.g., a 2-hydroxyethyl group, a 3-hydroxypropyl group, a 2,3-dihydroxypropyl group, a 3-hydroxy-2-hydroxymethyl-2-methylpropyl group, a 3-hydroxy-2,2-di(hydroxymethyl) propyl group, a polyoxyethylene group, a polyoxypropylene group, etc.), and homopolymers or copolymers of N-substituted acrylamide or methacrylamide containing at least one hydroxyl group (examples of N-substituents include, e.g., a monomethylol group, a 2-hydroxyethyl group, a 3-hydroxypropyl group, a 1,1-bis(hydroxymethyl) ethyl group, a 2,3,4,5,6-pentahydroxypentyl group, etc.). However, the synthetic polymer is not particularly limited so long as it contains at least one hydroxyl group in the side chain substituent of the repeating unit thereof.

These hydrophilic resins preferably have a weight average molecular weight of from $10^3$ to $10^6$, more preferably from $5\times10^3$ to $4\times10^5$.

The content of the silyl functional group in the hydrophilic resins according to the present invention is generally from 0.01 to 50 mol %, preferably from 0.1 to 20 mol %, and more preferably from 0.2 to 15 mol %, in terms of the unit component having the silyl functional group. When the hydrophilic resin is saccharide or protein, the unit component means monosaccharide or amino acid, which constitutes the saccharide or protein, respectively. The unit component may have a plurality of silyl functional groups.

The silyl functional group may be connected to a side chain of the repeating unit of the polymer or a terminal of the polymer main chain directly or via a linking group. Any linking group may be used as the linking group, e.g., —O—, —$CR^{11}R^{12}$— (where $R^{11}$ and $R^{12}$, which may be the same or different, each represents a hydrogen atom, a halogen atom (e.g., fluorine, chlorine, bromine), an —OH group, a cyano group, an alkyl group (methyl, ethyl, 2-chloroethyl, 2-hydroxyethyl, propyl, butyl, etc.), an aralkyl group (e.g., benzyl, phenethyl, etc.), a phenyl group, etc.), —S—, —$NR^{13}$— (where $R^{13}$ represents a hydrogen atom or a hydrocarbon group (the hydrocarbon group is a hydrocarbon group having from 1 to 8 carbon atoms (e.g., methyl, ethyl, propyl, butyl, hexyl, 2-methoxyethyl, 2-chloroethyl, 2-cyanoethyl, benzyl, methylbenzyl, phenethyl, phenyl, tolyl chlorophenyl, methoxyphenyl, etc.))), —CO—, —COO—, —OCO—, —$CONR^{13}$—, —$SO_2NR^{13}$—, —$SO_2$—, —NHCONH—, —NHCOO—, —$NHSO_2$—, —CONHCOO—, and —CONHCONH—, and these linking groups may be used alone or in combination of two or more.

The hydrophilic resins containing a silyl functional group represented by formula (I) which are used in the present invention may be used alone or in combination of two or more.

These hydrophilic resins easily form a siloxane bond represented by the following formula (I') upon a condensation reaction of an —$Si(R)_n(OX)_{3-n}$ group during the drying step with heating after film formation to cause crosslinking between the resins:

(I')

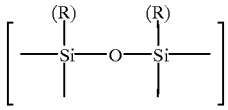

Thus, the image-receiving layer is hardened to maintain a sufficient film strength. Although the reason is unknown in detail, the surface of the image-receiving layer according to the present invention is sufficiently hydrophilic and, at the same time, adhesion of the image thereto is extremely good and thus the press life of a printing plate prepared is conspicuously improved.

It is preferred that the dispersion for the image-receiving layer in the embodiment further contains gelatin and a gelatin-hardening compound.

By using gelatin in combination with the binder resin for the image-receiving layer in the embodiment, the dispersion of the components for the image-receiving layer becomes easy, and uniform dispersion of the inorganic pigment is further accelerated. As a result, the film strength of the image-receiving layer is improved, the smoothness of the surface of the image-receiving layer is controlled in a finely uneven state, and the adhesion of the image to the image area and hydrophilicity in the non-image area are more improved.

The gelatin for use in the present invention is a kind of derived proteins and there is no particular limitation on gelatin so long as it is called gelatin produced from collagen. The gelatin is preferably light-colored, transparent, tasteless and odorless. Further, gelatin for a photographic emulsion is preferably used because physical properties, such as the viscosity of the resulting aqueous solution and jelly strength of gel are within a constant range.

The weight ratio of the hydrophilic resin modified by a silyl functional group represented by formula (I) to gelatin is preferably from 90/10 to 10/90, more preferably from 70/30 to 30/70.

By the use of a gelatin-hardening compound in combination, the image-receiving layer is hardened and the water resisting property is improved.

Well-known gelatin-hardening compounds can be used in the present invention. With respect to gelatin-hardening compounds, e.g., T. H. James, *The Theory of the Photographic Processes*, Chap 2, Section III, Macmillan Publishing Co., Inc. (1977), and *Research Disclosure*, No. 17643, p. 26 (December 1970) can be referred to.

As preferred examples of gelatin-hardening compounds, dialdehydes such as succinaldehyde, glutaraldehyde, and adipoaldehyde, diketones (e.g., 2,3-butanedione, 2,5-hexanedione, 3-hexene-2,5-dione, 1,2-cyclopentanedione, etc.), and active olefin compounds having two or more double bonds and electron attractive groups bonded adjacent to the double bonds can be exemplified.

More preferably, the gelatin-hardening compound is a compound having two or more double bond groups represented by the above formula (II) in the molecule.

In formula (II), $R^1$ preferably represents a hydrogen atom or an alkyl group having from 1 to 6 carbon atoms which may be substituted (e.g., methyl, ethyl, propyl, butyl, methylol, 2-chloroethyl, 2-hydroxyethyl, 2-hydroxypropyl, 2-carboxyethyl, 3-methoxypropyl, etc.). In formula (II), W preferably represents —$SO_2$—.

Specific examples of the gelatin-hardening compounds include resorcinol-bis(vinylsulfonate), 4,6-bis(vinylsulfonyl)-m-xylene, bis(vinylsulfonylalkyl)ether, bis(vinylsulfonylalkyl)amine, 1,3,5-tris(vinylsulfonyl)hexahydro-s-triazine, 1,3,5-triacryloylhexahydro-s-triazine, diacrylamide, 1,3-bis(acryloyl)urea, and N,N'-bismaleimides.

The gelatin-hardening compound is preferably used in an amount of from 0.5 to 20 weight parts, more preferably from 0.8 to 10 weight parts, per 100 weight parts of the gelatin. In this range, the resulting image-receiving layer maintains sufficient film strength and exhibits superior water resisting property without hindering the hydrophilicity of the image-receiving layer.

In the image-receiving layer according to the present invention, the weight ratio of the inorganic pigment to the hydrophilic resin is preferably from 85/15 to 50/50, more preferably 85/15 to 60/40. Within this range, the effects of the present invention, e.g., the film strength, the prevention of the adhesion of the printing ink in the non-image area, and the adhesion of the image in the image area (the press life of the printing plate) can be efficiently obtained.

The image-receiving layer in this embodiment may contain other components in addition to the above components.

As one example of other components which can be used, an inorganic pigment other than the silica particles and ultra-fine inorganic pigment particles according to the present invention can be exemplified. Examples of such inorganic pigments include, e.g., kaolin, clay, calcium carbonate, barium carbonate, calcium sulfate, barium sulfate, magnesium carbonate, and metallic oxides such as magnesium oxide, titanium oxide, zirconium oxide, and zinc oxide. When other inorganic pigments are additionally used, they can be used in an amount not exceeding 20 wt % based on the silica particles according to the present invention.

The image-receiving layer in this embodiment may contain various additives such as a surface adjusting agent for improving the coating property of the coating dispersion for the image-receiving layer, a defoaming agent and a buffer for adjusting the pH of the layer.

The thickness of the image-receiving layer in this embodiment is from about 3 to about 30 g calculated in terms of the coating amount of the composition of the image-receiving layer per $m^2$ (dry basis).

The above-described image-receiving layer is specifically disclosed in JP-A-10-359383.

In another preferred embodiment of the present invention, the image-receiving layer contains at least one kind of particles which have an average particle diameter of from 0.01 to 5 $\mu$m and comprise atoms having interatomic ionic bonding rate of Pauling of the compound of 0.2 or more and which is selected from hydrate metallic compounds, metallic oxides and double oxides, and a binder resin containing a complex comprising: a resin having a siloxane bond connected with Si via an oxygen atom; and an organic polymer containing a group capable of bonding with the above resin via a hydrogen bonding.

The above hydrate metallic compound, metallic oxide and double oxide may be any compounds so long as they comprise atoms having interatomic ionic bonding rate of Pauling of the compound of 0.2 or more, preferably 0.3 or more. "Ionic bonding rate of Pauling" used herein is described in *Ceramic Zairyogaku* (*Study of Ceramic Materials*), Kaibundo Co. (1990) and *Daigatuin Mukikagaku* (*Inorganic Chemistry—Postgraduate Course*) *First Vol.*, Kodansha Co. (1992).

Specifically, of higher compounds comprising two or more oxides, the compound in which the presence of a group ion as oxyacid is not observed is referred to as a double oxide (in some cases higher compounds comprising three or more oxides are called double oxides). Double oxides for use in the present invention contain at least one metallic atom selected from Mg, Al, Si, Ti, Zr, V, Sn, Cr, Mo, W and Nb, and contain as other atoms, besides these atoms, one or more metallic atoms selected from Li, Ca, Ba, Sr, Bi, Zn, Pb, Co, Mn, Cu, Ni, La and Ge. The double oxides are preferably double oxides comprising two metallic atoms.

The metallic oxides for use in the present invention contain a metallic atom selected from Mg, Ba, Ge, Sn, Zn, Pb, La, Zr, V, Cr, Mo, W, Mn, Co, Ni and Cu. Any of these metal oxides can be used so long as they do not cause a problem with respect to the stability and safety of materials. Metal oxides containing a metallic atom selected from Mg, Ge, Sn, Zn, Pb, Zr, V, Cr, W, Ni and Cu are preferred.

Hydrate metallic compounds for use in the present invention contain a metallic atom selected from Mg, Al, Zn, Ti, Ge, Co, Zr, Sn, Fe, Cu, Ni, Pb, Pd, Cd, Cr, Ga, Mn, V, Ce and La. Any of these hydrate metallic compounds can be used so long as they do not cause a problem with respect to the stability and safety of materials. Hydrate metallic compounds containing a metallic atom selected from Mg, Al, Fe, Ti and Zn are preferred.

The hydrate metallic compounds for the image-receiving layer according to the present invention are hydrate metallic compounds of the above metallic atoms and represented by $M(O)(OH)_n$ or $M_xO_y.xH_2O$ (wherein M represents a metallic atom, and n, m, x and y each represents an integer).

Any compounds can be used as the double oxide, metallic oxide and hydrate metallic compound according to the present invention so long as they do not cause a problem with respect to the stability and safety of materials. These compounds preferably have an average particle diameter of from 0.01 to 10 $\mu$m, more preferably from 0.02 to 8 $\mu$m. At an average particle diameter in this range, the preferred surface smoothness of the image-receiving layer and the sufficient strength of the image area after image formation are ensured and the occurrence of a stain due to adhesion of ink to the non-image area can be prevented.

These particles of the double oxide, metallic oxide and hydrate metallic compound can be produced according to conventionally well-known methods as described, e.g., in Nihon Kagakukai ed., *Jikken Kagaku Koza 9—Mukikagobutsu no Gosei to Seisei* (*Experimental Chemistry Course 9—Synthesis and Purification of Inorganic Compounds*), Maruzen Co., Ltd. (1958), and Kagaku Daijiten Henshu Iinkai ed., *Kagaku Daijiten* (*Encyclopaedia Chimica*) 3, pp. 890 to 949, Kyoritsu Shuppan Co. (1963). These particles are also available as commercial products (e.g., Kanto Kagaku Co., Ltd. and Wako Pure Chemical Industries Ltd.) as described, e.g., in Shikizai Kyokai ed., *Shikizai Handbook* (*Coloring Material Handbook*), p. 250, Asakura Shoten Co. (1989) and Akira Misonoo et al., *Toryo•Ganryo* (*Paints and Pigments*), p. 184, Nikkan Kogyo Shinbunsha Co. (1960).

The binder resin for use in the image-receiving layer according to the present invention comprises a complex comprising a resin having a siloxane bond connected with Si via an oxygen atom (hereinafter referred to as "a siloxane polymer"), and an organic polymer containing a group capable of bonding with the above resin via hydrogen bonding. The terminology "a complex comprising a siloxane polymer and an organic polymer" includes both a sol substance and a gel substance.

The siloxane polymer means a polymer mainly containing a bond consisting of "oxygen atom-silicon atom-oxygen atom". The siloxane polymer preferably contains a hydroxyl group in the substituent of the main chain of the polymer and/or at the terminal of the main chain. The siloxane polymer may contain a hydrocarbon group, if necessary. Thus, the formation of a uniform layer and the adhesion of the image area can be controlled corresponding to the inorganic particles and the organic polymer used in combination.

The siloxane polymer for use in the present invention is preferably a polymer obtained by hydrolysis polycondensation reaction of the silane compound represented by formula (III). The hydrolysis polycondensation reaction is a reaction of repeating hydrolysis and condensation of a hydrolyzable group under an acidic condition or basic condition for polymerization to thereby form a hydroxyl group. The silane compounds can be used alone or as a mixture of two or more.

The silane compound represented by formula (III) will be described in detail below.

In formula (III), $R^0$ preferably represents a hydrogen atom, a straight chain or branched alkyl group having from 1 to 12 carbon atoms which may be substituted (e.g., methyl, ethyl, propyl, butyl, pentyl, hexyl, heptyl, octyl, nonyl, decyl, dodecyl, etc., these groups may be substituted with one or more substituents including, e.g., a halogen atom (e.g., chlorine, fluorine, bromine), a hydroxyl group, a thiol group, a carboxyl group, a sulfo group, a cyano group, an epoxy group an —OR' group (wherein R' represents a hydrocarbon group, e.g., methyl, ethyl, propyl, butyl, hexyl, heptyl, octyl, decyl, propenyl, butenyl, hexenyl, octenyl, 2-hydroxyethyl, 3-chloropropyl, 2-cyanoethyl, N,N-dimethylaminoethyl, 2-bromoethyl, 2-(2-methoxyethyl) oxyethyl, 2-methoxycarbonylethyl, 3-carboxypropyl, benzyl, etc.), an —OCOR' group, a —COOR' group, a —COR' group, an —N(R")(R") group (wherein R", which may be the same or different, each represents a hydrogen atom or the same group as defined for R' above), an —NHCONHR' group, an —NHCOOR' group, an $—Si(R')_3$ group, —CONHR" group, or an —NHCOR' group); a straight chain or branched alkenyl group having from 2 to 12 carbon atoms which may be substituted (e.g., vinyl, propenyl, butenyl, pentenyl, hexenyl, octenyl, decenyl, dodecenyl, etc., these groups may be substituted with one or more substituents selected from the groups described for the alkyl group above); an aralkyl group having from 7 to 14 carbon atoms which may be substituted (e.g., benzyl, phenethyl, 3-phenylpropyl, naphthylmethyl, 2-naphthylethyl, etc, these groups may be substituted with one or more substituents selected from the groups described for the alkyl group above); an alicyclic group having from 5 to 10 carbon atoms which may be substituted (e.g., cyclopentyl, cyclohexyl, 2-cyclohexylethyl, 2-cyclopentylethyl, norbornyl, adamantyl, etc., these groups may be substituted with one or more substituents selected from the groups described for the alkyl group above); an aryl group having from 6 to 12 carbon atoms which may be substituted (e.g., phenyl, naphthyl, these groups may be substituted with one or more substituents selected from the groups described for the alkyl group above); or a heterocyclic group which may be condensed and containing at least one atom selected from a nitrogen atom, an oxygen atom and a sulfur atom (examples of the hetero rings include pyran, furan, thiophene, morpholine, pyrrole, thiazole, oxazole, pyridine, piperidine, pyrrolidone, benzothiazole, benzoxazole, quinoline, tetrahydrofuran, etc., these groups may be substituted with one or more substituents selected from the groups described for the alkyl group above).

In formula (III), Y preferably represents a halogen atom (e.g., fluorine, chlorine, bromine, iodine), an —$OR^2$ group, an —$OCOR^3$ group, or an —$N(R^4)(R^5)$ group.

In the —$OR^2$ group, $R^2$ represents an aliphatic group having from 1 to 10 carbon atoms which may be substituted (e.g., methyl, ethyl, propyl, butyl, pentyl, hexyl, heptyl, octyl, nonyl, decyl, propenyl, butenyl, heptenyl, hexenyl, octenyl, decenyl, 2-hydroxyethyl, 2-hydroxypropyl, 2-methoxyethyl, 2-(methoxyethyloxy)ethyl, 2-(N,N-diethylamino)ethyl, 2-methoxypropyl, 2-cyanoethyl, 3-methyloxypropyl, 2-chloroethyl, cyclohexyl, cyclopentyl, cyclooctyl, chlorocyclohexyl, methoxycyclohexyl, benzyl, phenethyl, dimethoxybenzyl, methylbenzyl, bromobenzyl, etc.).

In the —$OCOR^3$ group, $R^3$ represents an aliphatic group as defined for $R^2$ above, or an aromatic groups having from 6 to 12 carbon atoms which may be substituted (e.g., aryl groups as described for $R^0$ above)

In the —$N(R^4)(R^5)$ group, $R^4$ and $R^5$, which may be the same or different, each represent a hydrogen atom or an aliphatic group having from 1 to 10 carbon atoms which may be substituted (e.g., aliphatic groups as described for $R^2$ in the —$OR^2$ group). More preferably, the total number of carbon atoms contained in $R^4$ and $R^5$ is 16 or less.

Specific examples of the silane compounds represented by formula (III) include the following compounds but the present invention is not limited thereto: methyltrichlorosilane, methyltribromosilane, methyltrimethoxysilane, methyltriethoxysilane, methyltriisopropoxysilane, methyltri-t-butoxysilane, ethyltrichlorosilane, ethyltribromosilane, ethyltrimethoxysilane, ethyltriethoxysilane, ethyltriisopropoxysilane, ethyltri-t-butoxysilane, n-propyltrichlorosilane, n-propyltribromosilane, n-propyltrimethoxysilane, n-propyltriethoxysilane, n-propyltriisopropoxysilane, n-propyltri-t-butoxysilane, n-hexyltrichlorosilane, n-hexyltribromo-silane, n-hexyltrimethoxysilane, n-hexyltriethoxysilane, n-hexyltriisopropoxysilane, n-hexyltri-t-butoxysilane, n-decyltrichlorosilane, n-decyltribromosilane, n-decyltrimethoxysilane, n-decyltriethoxysilane, n-decyltriisopropoxysilane, n-decyltri-t-butoxysilane, n-octadecyltrichlorosilane, n-octadecyltribromosilane, n-octadecyltrimethoxysilane, n-octadecyltriethoxysilane, n-octadecyltriisopropoxysilane, n-octadecyltri-t-butoxysilane, phenyltrichlorosilane, phenyltribromosilane, phenyltrimethoxysilane, phenyltriethoxysilane, phenyltriisopropoxysilane, phenyltri-t-butoxysilane, tetrachlorosilane, tetrabromosilane, tetramethoxysilane, tetraethoxysilane, tetraisopropoxysilane, tetrabutoxysilane, dimethoxydiethoxysilane, dimethyldichlorosilane, dimethyldibromosilane, dimethyldimethoxysilane, dimethyldiethoxysilane, diphenyldichlorosilane, diphenyldibromosilane, diphenyldimethoxysilane, diphenyldiethoxysilane, phenylmethyldichlorosilane, phenylmethyldibromosilane, phenylmethyldimethoxysilane, phenylmethyldiethoxysilane, triethoxyhydrosilane, tribromohydrosilane, trimethoxyhydrosilane, isopropoxyhydrosilane, tri-t-butoxyhydrosilane, vinyltrichlorosilane, vinyltribromosilane, vinyltrimethoxysilane, vinyltriethoxysilane, vinyltriisopropoxysilane, vinyltri-t-butoxysilane, trifluoropropyltrichlorosilane, trifluoropropyltribromosilane, trifluoropropyltrimethoxysilane, trifluoropropyltriethoxysilane, trifluoropropyltriisopropoxysilane, trifluoropropyltri-t-butoxysilane, γ-glycidoxypropylmethyldimethoxysilane, γ-glycidoxypropylmethyldiethoxysilane, γ-glycidoxypropyltrimethoxysilane, γ-glycidoxypropyltriethoxysilane, γ-glycidoxypropyltriisopropoxysilane, γ-glycidoxypropyltri-t-butoxysilane, γ-methacryloxypropylmethyidimethoxysilane, γ-methacryloxypropylmethyldiethoxysilane, γ-methacryloxypropyltrimethoxysilane, γ-methacryloxypropyltriisopropoxysilane, γ-methacryloxypropyltri-t-butoxysilane, γ-aminopropylmethyldimethoxysilane, γ-aminopropylmethyldiethoxysilane, γ-aminopropyltrimethoxysilane, γ-aminopropyltriethoxysilane, γ-aminopropyltriisopropoxysilane, γ-aminopropyltri-t-butoxysilane, γ-mercaptopropylmethyldimethoxysilane, γ-mercaptopropylmethyldiethoxysilane, γ-mercaptopropyltrimethoxysilane, γ-mercaptopropyltriethoxysilane, γ-mercaptopropyitriisopropoxysilane, γ-mercaptopropyltri-t-butoxysilane, β-(3,4-epoxycyclohexyl) ethyltrimethoxysilane, and β-(3,4-epoxycyclohexyl) ethyltriethoxysilane.

In combination with the silane compound represented by formula (III) which is used for the formation of the image-receiving layer according to the present invention, a metallic compound capable of forming film by a sol-gel method, such as Ti, Zn, Sn, Zr, or Al compound can be used.

Specific examples of the metallic compound usable in combination include $Ti(OR^6)_4$ (wherein $R^6$ represents methyl, ethyl, propyl, butyl, pentyl, hexyl, etc., the same applies to the following), $TiCl_4$, $Zn(OR^6)_2$, $Zn(CH_3COCHCOCH_3)_2$, $Sn(OR^6)_4$, $Sn(CH_3COCHCOCH_3)_4$, $Sn(OCOR^6)_4$, $SnCl_4$, $Zr(OR^6)_4$, $Zr(CH_3COCHCOCH_3)_4$, and $Al(OR^6)_3$.

The organic polymers which are used in this embodiment will be described in the next place.

The organic polymers for use in this embodiment contain a group capable of forming a hydrogen bond with the siloxane bond-containing resins. Such groups preferably include at least a bond selected from an amido bond (including a carboxylic acid amido bond and a sulfonamido bond), a urethane bond, and a ureido bond, and a hydroxyl group.

The organic polymers contain at least a group capable of forming a hydrogen bond with the siloxane bond-containing resins (hereinafter referred to as merely a specific bond-forming group of the present invention) on the main chain and/or the side chain of the polymer as a repeating unit. The organic polymers preferably contain a polymer containing, as a repeating unit component, a component having at least one bond selected from —$N(R^{11})CO$—, —$N(R^{11})SO_2$—, —NHCONH— and —NHCOO— on the main chain and/or the side chain, and a polymer containing, as a repeating unit component, a component having a hydroxyl group. In the above amido bonds, $R^{11}$ represents a hydrogen atom or an organic residue, and the organic residue includes the hydrocarbon group and the heterocyclic group represented by $R^0$ in formula (III).

As the organic polymer containing the specific bond-forming group of the present invention on the main chain, amide resins having an —$N(R^{11})CO$— bond or an —$N(R^{11})SO_2$— bond, ureido resins having —NHCON— bond, and urethane resins having —NHCOO— bond can be exemplified.

As diamines and dicarboxylic acids or disulfonic acids used for producing amide resins, diisocyanates used for producing ureido resins, and diols used for producing urethane resins, the compounds described, e.g., in Kobunshi Gakkai ed., *Kobunshi Data Handbook—Kisohen* (*Polymer Data Handbook—Fundamental Course*), Chap. 1, Baifukan Co. (1986) and Shinzo Yamashita and Tosuke Kaneko ed., *Kakyozai Handbook* (*Handbook of Crosslinkinp Agents*), Taiseisha Co. (1981) can be used.

Other examples of polymers containing an amido bond include a polymer containing a repeating unit represented by the following formula (IV), N-acylated polyalkyleneimine, and polyvinyl pyrrolidone and derivatives thereof.

(IV)

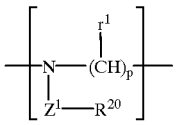

wherein $Z^1$ represents —CO—, —$SO_2$— or —CS—; $R^{20}$ represents the same group as defined for $R^0$ in formula (III); $r^1$ represents a hydrogen atom or an alkyl group having from 1 to 6 carbon atoms (e.g., methyl, ethyl, propyl, butyl, pentyl, hexyl, etc.), and a plurality of $r^1$ may be the same or different; and p represents an integer of 2 or 3.

Of the polymers containing a repeating unit represented by formula (IV), a polymer wherein $Z^1$ represents —CO— and p represents 2 can be obtained by ring-opening polymerization of oxazoline, which may have a substituent, in the presence a catalyst. Examples of the catalysts include sulfate and sulfonate (e.g., dimethyl sulfate, alkyl p-toluenesulfonate); alkyl halide such as alkyl iodide (e.g., methyl iodide); a fluorinated metallic compound of Friedel-Crafts catalyst; an acid (e.g., sulfuric acid, hydrogen iodide, p-toluenesulfonic acid), and oxazolinium salts formed from these acids and oxazoline. These polymers may be homopolymers or copolymers. Graft copolymers of these polymers grafted to other polymers may be used.

Examples of oxazolines include, e.g., 2-oxazoline, 2-methyl-2-oxazoline, 2-ethyl-2-oxazoline, 2-propyl-2-oxazoline, 2-isopropyl-2-oxazoline, 2-butyl-2-oxazoline, 2-dichloromethyl-2-oxazoline, 2-trichloromethyl-2-oxazoline, 2-pentafluoroethyl-2-oxazoline, 2-phenyl-2-oxazoline, 2-methoxycarbonylethyl-2-oxazoline, 2-(4-methylphenyl)-2-oxazoline, and 2-(4-chlorophenyl)-2-oxazoline. Of these, preferred are 2-oxazoline, 2-methyl-2-oxazoline, and 2-ethyl-2-oxazoline. These oxazoline polymers may be used alone or in combination of two or more.

Other polymers having a repeating unit represented by formula (IV) can also be obtained in the same manner as above using thiazoline, 4,5-dihydro-1,3-oxazine or 4,5-dihydro-1,3-thiazine in place of oxazoline.

Examples of the N-acylated polyalkyleneimines include a carboxylic acid amide compound containing —N(CO—$R^{20}$)— (where $R^{20}$ has the same meaning as defined above in formula (IV)) obtained by a polymer reaction of polyalkyleneimine with carboxylic halide and sulfonamido compound containing —N($SO_2$—$R^{20}$)— obtained by a polymer reaction of polyalkyleneimine with sulfonyl halides.

As the polymers containing the specific bond-forming group of the present invention on the side chain of the polymer, those containing at least one bond-forming group selected from the specific bond-forming groups as a main component can be exemplified. Specific examples of the components having the specific bond include repeating units derived from acrylamide, methacrylamide, crotonamide, vinyl acetamide and the following repeating units, but the present invention is not limited thereto.

(1)

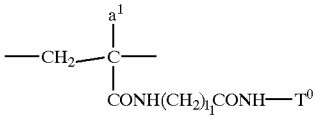

$a^1$: —H, —$CH_3$
$l_1$: an integer from 1 to 4
$T^0$: —H, —$CH_3$, —$(CH_2)_2OCH_3$, —$(CH_2)_2N(CH_3)_2$ (2)

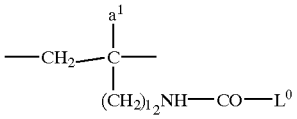

$L_2$: 0 or 1
$L^0$: —$C_{n1}H_{2n1+1}$
($n_1$: an integer of from 1 to 4)
—$(CH_2)_2OCH_3$,
—$(CH_2)_3N(CH_3)_2$,
—$CH_2C_6H_5$, —$(CH_2)_{n1}OH$ (3)

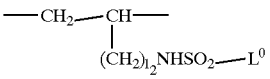

(4)

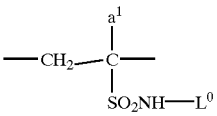

(5)

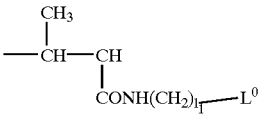

(6)

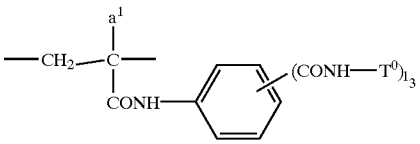

$l^3$: 0 or an integer of 1 or 2

(7)

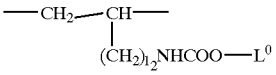

(8)

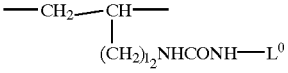

(9)

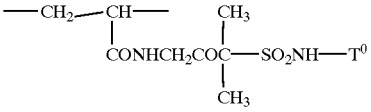

-continued (10)

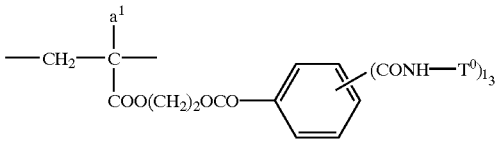

(11)

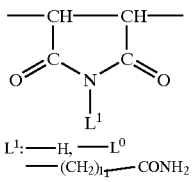

(12)

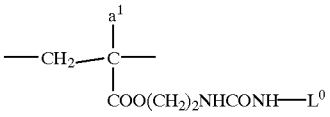

(13)

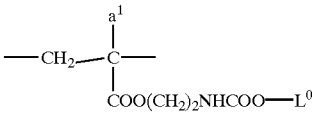

(14)

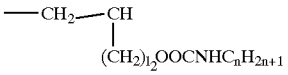

(15)

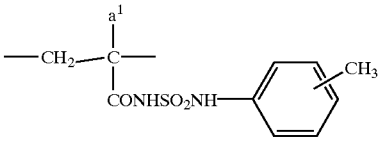

(16)

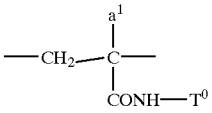

The organic polymer containing a hydroxyl group may be any of natural water-soluble polymers, semisynthetic water-soluble polymers, and synthetic polymers, and examples include those described, for example, in Munio Kotake supervised, *Dai Yukikagaku* (*Grand Organic Chemistry*), 19: *Tennen Kobunshi Kagobutsu* (*Natural Polymer Compounds*), *I*, Asakura Shoten Co. (1960), Keiei Kaihatsu Center Publishing Division compiled, *Suiyosei Kobunshi•Mizubunsangata Jushi Sogo Gijutsu Shiryoshu* (*Water-Soluble Polymers•Aqueous Dispersion Type Resins, Collective Technical Data*, published by Keiei Kaihatsu Center Publishing Division (1981), Shinji Nagatomo, *Shin Suiyosei Polymer no Oyo to Shijo* (*New Applications and Market of Water-Soluble Polymers*), CMC Publishing Co. (1988), *Kinosei Cellulose no Kaihatsu* (*Development of Functional Cellulose*), CMC Publishing Co. (1985).

Specific examples of the natural and semisynthetic polymers include cellulose, cellulose derivatives (e.g., cellulose esters such as cellulose nitrate, cellulose sulfate, cellulose acetate, cellulose propionate, cellulose succinate, cellulose butyrate, cellulose acetate succinate, cellulose acetate butyrate, cellulose acetate phthalate; and cellulose ethers such as methyl cellulose, ethyl cellulose, cyanoethyl cellulose, carboxymethyl cellulose, hydroxyethyl cellulose, hydroxypropyl cellulose, ethylhydroxyethyl cellulose, hydroxypropylmethyl cellulose, carboxymethylhydroxyethyl cellulose, etc.), starch, starch derivatives (e.g., oxidized starch, esterified starches including those esterified with an acid such as nitric acid, sulfuric acid, phosphoric acid, acetic acid, propionic acid, butyric acid, or succinic acid; and etherified starches such as methylated starch, ethylated starch, cyanoethylated starch, hydroxyalkylated starch, or carboxymethylated starch), alginic acid, pectin, carrageenan, tamarind gum, natural rubbers (e.g., gum arabic, guar gum, locust bean gum, tragacanth gum, xanthane gum, etc.), pullulan, dextran, casein, gelatin, chitin, and chitosan.

Examples of synthetic polymers include polyvinyl alcohol, polyalkylene glycol (e.g., polyethylene glycol, polypropylene glycol, ethylene glycol-propylene glycol copolymers, etc.), allyl alcohol copolymers, acrylate copolymers, methacrylate copolymers, homopolymers or copolymers of acrylate or methacrylate containing at least one hydroxyl group (examples of ester substituents include, e.g., a 2-hydroxyethyl group, a 3-hydroxypropyl group, a 2,3-dihydroxypropyl group, a 3-hydroxy-2-hydroxymethyl-2-methylpropyl group, a 3-hydroxy-2,2-di(hydroxymethyl) propyl group, a polyoxyethylene group, a polyoxypropylene group, etc.), and homopolymers or copolymers of N-substituted acrylamide or methacrylamide containing at least one hydroxyl group (examples of N-substituents include, e.g., a monomethylol group, a 2-hydroxyethyl group, a 3-hydroxypropyl group, a 1,1-bis(hydroxymethyl) ethyl group, a 2,3,4,5,6-pentahydroxypentyl group, etc.). However, the synthetic polymer is not particularly limited so long as it contains at least one hydroxyl group in the side chain substituent of the repeating unit thereof.

These hydrophilic resins preferably have a weight average molecular weight of from $10^3$ to $10^6$, more preferably from $5\times10^3$ to $4\times10^5$.

In the complex comprising a siloxane polymer and an organic polymer in this embodiment, the ratio of the siloxane polymer to the organic polymer can be selected from a wide range, but the weight ratio of the siloxane polymer/organic polymer is preferably from 10/90 to 90/10, more preferably from 20/80 to 80/20. In this range, the film strength of the image-receiving layer and the water resistance of the image-receiving layer against dampening water during printing can be improved.

It is presumed that the binder resin comprising the complex of the embodiment forms uniform organic/inorganic hybrid by the function of the hydrogen bonds generated between the hydroxyl groups of the siloxane polymer produced by the hydrolysis polycondensation of the silane compounds described above and the specific bond-forming groups in the organic polymer, and is microscopically homogeneous without causing phase separation, thus the affinity between the siloxane polymer and the organic polymer is well maintained. Further, when the hydrocarbon group is included in the siloxane polymer, the affinity between the siloxane polymer and the organic polymer is further improved due to the presence of the hydrocarbon group The complex of the present invention is superior in a film-forming property.

The resins of the organic/inorganic polymer complex can be produced easily by subjecting the silane compound to hydrolysis polycondensation and mixing with the organic polymer, alternatively by performing the hydrolysis polycondensation of the silane compound in the presence of the organic polymer.

Preferably, the organic/inorganic polymer complex can be obtained by the hydrolysis polycondensation of the silane compound by a sol-gel method in the presence of the organic polymer. In the produced organic/inorganic polymer complex, the organic polymer is uniformly dispersed in a matrix (that is, three-dimensional micro-network structure of the inorganic metallic oxide) of gel produced by the hydrolysis polycondensation of the silane compound.

The sol-gel method described above as a preferred method can be performed by conventionally well-known methods. The details of the sol-gel method are described in *Sol-Gel ni yoru Hakumaku Coating Gijutsu* (*Thin Film Coating Technology by Sol-Gel Method*, Gijutsujoho Kyokai (1995), Sumio Sakibana, *Sol-Gel Ho no Kagaku* (*Science of Sol/Gel Method*), Agne Shofu-Sha (1988), and Seki Hirashima, *Saishin Sol-Gel Ho ni yoru Kino-Sei Hakumaku Sakusei Gijutsu* (*Latest Technology of Functional Thin Film by Sol-Gel Method*), Sogo Gijutsu Center (1992).

An aqueous solvent is preferably used in the coating solution for the image-receiving layer according to this embodiment, further, a water-soluble solvent may be used in combination for preventing the occurrence of precipitation during preparation of the coating solution to thereby obtain a homogeneous solution. Examples of water-soluble solvents include alcohols (e.g., methanol, ethanol, propyl alcohol, ethylene glycol, diethylene glycol, propylene glycol, dipropylene glycol, ethylene glycol monomethyl ether, propylene glycol monomethyl ether, ethylene glycol monoethyl ether, etc.), ethers (e.g., tetrahydrofuran, ethylene glycol dimethyl ether, propylene glycol dimethyl ether, tetrahydropyran, etc.), ketones (e.g., acetone, methyl ethyl ketone, acetylacetone, etc.), esters (e.g., methyl acetate, ethylene glycol monomethyl monoacetate, etc.), and amides (e.g., formamide, N-methylformamide, pyrrolidone, N-methylpyrrolidone, etc.), and the solvent may be used alone or two or more solvents may be used in combination.

Further, it is preferable to use an acidic or basic catalyst to accelerate the hydrolysis and polycondensation reaction of the silane compound represented by formula (III).

As the catalysts for the above purpose, an acidic or basic compound may be used as it is, or may be dissolved in water or a solvent such as alcohol (hereinafter referred to as the acidic catalyst or the basic catalyst). The concentration of the catalyst is not particularly restricted but when the concentration is high, hydrolysis and polycondensation reaction are liable to become fast. However, when the basic catalyst in high concentration is used, a precipitate is formed in some cases in a sol solution, therefore, the concentration of the basic catalyst is preferably 1N or less (calculated in terms of the concentration in an aqueous solution).

The kinds of the acidic catalyst or the basic catalyst are not restricted but when catalysts in high concentration must be used, however, catalysts constituted of the elements which hardly remain in the catalyst crystal grains after calcination are preferred. Specifically, as the acidic catalysts, hydrogen halide such as hydrochloric acid, carboxylic acids such as nitric acid, sulfuric acid, sulfurous acid, hydrogen sulfide, perchloric acid, hydrogen peroxide, carbonic acid, form-c acid and acetic acid, substituted carboxylic acid represented by RCOOH wherein R is substituted with other elements or substituents, and sulfonic acid such as benzenesulfonic acid can be exemplified, and as the basic catalysts, ammoniacal bases such as aqueous ammonia, and amines such as ethylamine and aniline can be exemplified.

In addition to the above components, the image-receiving layer of this embodiment may contain other components.

Examples of other components include inorganic pigment particles other than the specific particles according to the present invention, e.g., silica, alumina, kaolin, clay, titanium oxide, calcium carbonate, barium carbonate, calcium sulfate, barium sulfate, and magnesium carbonate. These inorganic pigments are used in an amount not exceeding 40 weight parts, more preferably not higher than 20 weight parts, based on 100 weight parts of the particles according to the present invention.

As for the ratio of the pigment in the image-receiving layer (the particles in the embodiment and, if necessary, other inorganic pigment particles) to the binder resin, the amount of the binder resin is in general from 8 to 50 weight parts, preferably from 10 to 30 weight parts, per 100 weight parts of the pigment. In this range, the effects of the present invention are efficiently exhibited, and the good film strength of the resulting image-receiving layer can be retained and the superior hydrophilicity of the non-image area can be maintained during printing. Further, the images are firmly adhered to the image-receiving layer and sufficient printing durability can be obtained without generating image failure even after a great number of sheets have been printed.

In addition, for further improving the film strength, a crosslinking agent may be added to the image-receiving layer. Compounds conventionally used as crosslinking agents can be used in the present invention. Specifically, the compounds described in Shinzo Yamashita and Tosuke Kaneko compiled, *Kakyozai Handbook* (*Handbook of Crosslinking Agents*), Taiseisha Co. (1981), Kobunshi Gakkai compiled, *Kobunshi Data Handbook—Kisohen* (*Polymer Data Handbook—Fundamental Course*), Baifukan Co. (1986) can be used as the crosslinking agent in the present invention.

Examples of the crosslinking agents which can be used in the present invention include ammonium chloride, metallic ions, organic peroxides, polyisocyanate compounds (e.g., toluylene diisocyanate, diphenylmethane diisocyanate, triphenylmethane triisocyanate, polymethylene phenylisocyanate, hexamethylene diisocyanate, isophorone diisocyanate, high molecular polyisocyanate, etc.), polyol compounds (e.g., 1,4-butanediol, polyoxypropylene glycol, polyoxyethylene glycol, 1,1,1-trimethylolpropane, etc.), polyamine compounds (e.g., ethylenediamine, γ-hydroxypropylated ethylenediamine, phenylenediamine, hexamethylenediamine, N-aminoethylpiperazine, modified aliphatic polyamines, etc.), polyepoxy group-containing compounds and epoxy resins (e.g., compounds described in Hiroshi Kakiuchi, *Shin Epoxy Jushi* (*New Epoxy Resins*), Shokodo Co. (1985), and Kuniyuki Hashimoto, *Epoxy Jushi* (*Epoxy Resins*), Nikkan Kogyo Shinbunsha Co. (1969)), melamine resins (e.g., compounds described in Ichiro Miwa and Hideo Matsunaga, *Urea•Melamine Jushi* (*Urea•Melamine Resins*), Nikkan Kogyo Shinbunsha Co. (1969)), and poly(meth)acrylate compounds (e.g., compounds described in Makoto Ogawara, Takeo Saegusa and Toshinobu Higashimura, *Oligomer* (*Oligomers*), Kodansha Co. (1976), and Eizo Omori, *Kino-sei Acryl-kei Jushi* (*Functional Acrylic resins*), Techno System Co. (1985)).

The thickness of the image-receiving layer is preferably from 0.2 to 10 μm, more preferably from 0.5 to 8 μm. In this range of the thickness, a layer having a uniform thickness can be formed and the sufficient film strength can be obtained.

The image-receiving layer in the above embodiment is specifically disclosed in U.S. patent application Ser. Nos. 09/436,807 and 09/473,501.

The coating solution for the image-receiving layer is coated on a water-resisting support by any conventionally well-known coating method.

On the other hand, as the image-receiving layer which is hydrophilized by a desensitizing treatment, e.g., a layer comprising zinc oxide and a hydrophobic binder can be exemplified.

Zinc oxides for use in the present invention may be any of the products commercially available by the names of zinc oxide, zinc flower, wet zinc flower, and active zinc flower, as described in Nihon Ganryo Gijutsu Kyokai ed., *Shinpan Ganryo Binran* (*Pigment Handbook, New Edition*, p. 319, Seibundo Co. (1968)

That is, zinc oxides are classified into French method (indirect method) and American method (direct method) as dry system, and wet system, and those available from, e.g., Seido Kagaku Co., Ltd., Sakai Chemical Industry Co., Ltd., Hakusui Kagaku Co., Ltd., Honjo Chemical Co., Ltd., Toho Aen Co., Ltd., and Mitsui Metallic Industry Co., Ltd. can be exemplified.

Examples of the resins used as a hydrophobic binder include vinyl chloride-vinyl acetate copolymers, styrene-butadiene copolymers, styrene-methacrylate copolymers, methacrylate copolymers, acrylate copolymers, vinyl acetate copolymers, polyvinyl butyral, alkyd resins, epoxy resins, epoxy ester resins, polyester resins and polyurethane resins These resins may be used alone or in combination of two or more.

The content of the resins in the image-receiving layer is preferably from 9191 to 20/80 by weight ratio of resin/zinc oxide.

For the desensitizing of zinc oxide, various desensitizing solutions are known, e.g., a cyan compound-containing desensitizing solution containing ferrocyanate or ferricyanate as a main component, a cyan-free desensitizing solution containing ammine cobalt complex, phytic acid and derivatives thereof, or guanidine derivatives as a main component, a desensitizing solution containing inorganic or organic acid which forms chelate with a zinc ion as a main component, and a desensitizing solution containing a water-soluble polymer.

For example, as the cyan compound-containing desensitizing solution, those disclosed in JP-B-44-9045, JP-B-46-39403, JP-A-52-76101, JP-A-57-107889, and JP-A-54-117201 can be exemplified.

The oil-based ink for use in the present invention will be described below.

The oil-based ink for use in the present invention is preferably a dispersion comprising hydrophobic resin particles, which are solid at least at normal temperature, dispersed in a non-aqueous solvent having an electric resistance of $10^9$ Ω·cm or more and a dielectric constant of 3.5 or less as a dispersion medium.

As the non-aqueous solvent having an electric resistance of $10^9$ Ω·cm or more and a dielectric constant of 3.5 or less, straight chain or branched aliphatic hydrocarbon, alicyclic hydrocarbon, aromatic hydrocarbon, and these hydrocarbons substituted with halogen are exemplified as preferred examples. Specific examples include, e.g., octane, isooctane, decane, isodecane, decalin, nonane, dodecane, indodecane, cyclohexane, cyclooctane, cyclodecane, benzene, toluene, xylene, mesitylene, Isopar E, Isopar G, Isopar H, Isopar L (Isopar: trade name of the products manufactured by Exon Co., Ltd.), Shell Sol 70, Shell Sol 71 (Shell Sol: trade name of the products manufactured by Shell Oil Co., Ltd.), and Amsco OMS and Amsco 460 solvents (Amsco: trade name of the products manufactured by Spirits Co., Ltd.). Further, the upper limit of the electric resistance of this non-aqueous solvent is about $10^{16}$ Ω·cm and the lower limit of the dielectric constant is about 1.9.

In the above range of the electric resistance of the non-aqueous solvent to be used, the electric resistance of ink becomes appropriate, as a result, electrolysis does not relax in ink and ink jetting is performed smoothly.

The resin particles dispersed in the above non-aqueous solvent may be sufficient if they are hydrophobic particles which are solid at temperatures lower than 35° C. and have the affinity with the non-aqueous solvent, but preferably the resins have a glass transition point of from −5° C. to 110° C. and a softening point of from 33° C. to 140° C., more preferably a glass transition point of from 10° C. to 100° C. and a softening point of from 38° C. to 120° C., and still more preferably a glass transition point of from 15° C. to 80° C. and a softening point of from 38° C. to 100° C.

With the use of resins having such a glass transition point and a softening point, the affinity of the surface of the image-receiving layer of the printing plate precursor with the resin particles increases, and the linkage of the resin particles to each other on the printing plate is strengthened, thus the adhesion of images to the image-receiving layer is improved and the press life increases. Contrary to this, the linkage of the resin particles o each is liable to decrease, when a glass transition point or a softening point is out of the above range, both higher or lower, The resin for use for the above resin particles has a weight average molecular weight (Mw) of from $1\times10^3$ to $1\times10^6$, preferably from $5\times10^3$ to $8\times10^5$, and more preferably from $1\times10^4$ to $5\times10^5$.

Specific examples of these resins include olefin homopolymers and copolymers (e.g., polyethylene, polypropylene, polyisobutylene, ethylene-vinyl acetate copolymer, ethylene-acrylate copolymer, ethylene-methacrylate copolymer, ethylene-methacrylic acid copolymer, etc.), vinyl chloride copolymers (e.g., polyvinyl chloride, vinyl chloride-vinyl acetate copolymer, etc.), vinylidene chloride copolymers, vinyl alcanate homopolymers and copolymers, allyl alcanate homopolymers and copolymers, homopolymers and copolymers of styrene and derivatives thereof (e.g., butadiene-styrene copolymer, isoprene-styrene copolymer, styrene-methacrylate copolymer, styrene-acrylate copolymer, etc.), acrylonitrile copolymers, methacrylonitrile copolymers, alkyl-vinyl ether copolymers, acrylate homopolymers and copolymers, methacrylate homopolymers and copolymers, diitaconate homopolymers and copolymers, maleic anhydride copolymers, acrylamide copolymers, methacrylamide copolymers, phenolic resins, alkyd resins, polycarbonate resins, ketone resins, polyester resins, silicon resins, amide resins, hydroxyl group- and carboxyl group-modified polyester resins, butyral resins, polyvinyl acetal resins, urethane resins, rosin resins, hydrogenated rosin resins, petroleum resins, hydrogenated petroleum resins, maleic resins, terpene resins, hydrogenated terpene resins, chroman-indene resins, cyclized rubber-methacrylate copolymers, cyclized rubber-acrylate copolymers, copolymers containing a heterocyclic ring not containing a nitrogen atom (examples of the heterocyclic rings include, e.g., a furan ring, a tetrahydrofuran ring, a thiophene ring, a dioxane ring, a dioxofuran ring, a lactone ring, a benzofuran ring, a benzothiophene ring, a 1,3-dioxetane ring, etc.), and expoxy resins.

The content of the resin particles dispersed in an oil-based ink is preferably from 0.5 to 20 wt % of the entire content of the ink In this range of the content, the affinity of the surface of the image-receiving layer of the printing plate precursor with the ink increases, and good images can be obtained, the press life is improved as well. Further, since a homogeneous dispersion solution can be obtained, clogging with the ink at the discharge part is reluctant to occur and ink jetting is effected stably.

It is preferred that a coloring material is added as a coloring component to the oil-based ink together with the above-described resin particles for dispersion for the purpose of inspecting the printing plate after plate-making or the like.

As such coloring materials, any of pigments and dyes which have so far been used as oil-based ink component or used in liquid developers for electrostatic photographs can be used in the present invention.

Inorganic and organic pigments generally used in the technical yield of printing can be used. Specifically, well-known pigments, e.g., carbon black, cadmium red, molybdenum red, chromium yellow, cadmium yellow, titanium yellow, chromium oxide, viridian, titanium cobalt green, ultramarine blue, prussian blue, cobalt blue; azo pigments, phthalocyanine pigments, quinacridone pigments, isoindolinone pigments, dioxazine pigments, indanthrene pigments, perylene pigments, perinone pigments, thioindigo pigments, quinophthalone pigments, and metal complex pigments can be used in the present invention with no limitation.

Oil-soluble dyes are preferably used in the present invention, specific examples of such dyes include azo dyes, metal complex salt dyes, naphthol dyes, anthraquinone dyes, indigo dyes, carbonium dyes, quinoneimine dyes, xanthene dyes, cyanine dyes, quinoline dyes, nitro dyes, nitroso dyes, benzoquinone dyes, naphthoquinone dyes, phthalocyanine dyes, and metallic phthalocyanine dyes.

Pigments and dyes can be used alone or may be used in arbitrary combination. The content is preferably from 0.01 to 5 wt % based on the entire weight of the ink.

These coloring materials themselves may be dispersed in the non-aqueous solvent as dispersed particles separately from the dispersed resin particles, or may be incorporated into the dispersed resin particles. When coloring materials are incorporated into the dispersed resin particles, the pigment is generally covered with the resin materials of the dispersed resins to make resin-covered particles, and the dye generally colors the surfaces of the dispersed resin particles to make colored particles.

Resin particles dispersed in the non-aqueous solvent inclusive of the colored particles preferably have an average particle diameter of from 0.05 to 5 $\mu$m, more preferably from 0.1 to 1.5. The particle diameter can be obtained by CAPA-500 (trade name, manufactured by Horiba Seisakusho Co., Ltd.).

Non-aqueous system dispersed resin particles for use in the oil-based ink according to the present invention can be prepared by conventionally well-known mechanical pulverizing methods or polymerization granulation methods. As mechanical pulverizing methods, a method wherein the materials of the resin particles are, if necessary, mixed, melted, kneaded and directly pulverized by any of well-known grinders, and the resulting fine particles are further dispersed together with a disperse polymer by a wet disperser (e.g., a ball mill, a paint shaker, a Keddy mill, an Aino mill, etc.), and a method of kneading the resin particle materials and a dispersion assisting polymer (or a covered polymer) in advance, pulverizing the obtained mixture and then dispersing the pulverized particles with a disperse polymer can be exemplified. Specifically, producing methods of paints and liquid developers for electrostatic photographs can be employed and these methods are described, e.g., in Kenji Ueki supervised, *Toryo no Ryudo to Ganryo Bunsan* (*Fluidity of Paints and Dispersion of Pigments*), Kyoritsu Shuppan Co. (1971), Solomon, *Paint and Surface Coating Theory and Practice*, Yuji Harasaki, *Coating Kogaku* (*Coating Engineering*), Asakura Shoten Co (1971), and ibid., (1977).

As the polymerization granulation method, conventionally known non-aqueous dispersion polymerization methods are exemplified, and these methods are specifically described, e.g., in Soichi Muroi supervised, *Cho-Biryushi Polymer no Saishin Gijutsu* (*Latest Technology of Ultra-Fine Polymer Particles*, Chap. 2, CMC Publishing Co. (1991), Koichi Nakamura compiled, *Saikin no Denshishashin Genzo System to Toner Zairyo no Kaihatsu•Jitsuyoka* (*Recent Development Systems in Electrophotography and Development and Practical Uses of Toner Materials*, Chap. 3, Nihon Kagaku Joho Co. (1985), and K. E. J. Barrett *Dispersion Polymerization in Organic Media*, John Wiley (1975).

In general, for dispersing and stabilizing resin particles in a non-aqueous solvent, a disperse polymer is used in combination. A disperse polymer contains a repeating unit soluble in a non-aqueous solvent as a main component and has a weight average molecular weight (Mw) of preferably from $1\times10^3$ to $1\times10^6$, more preferably from $5\times10^3$ to $5\times10^5$.

As the preferred soluble repeating unit of the disperse polymer for use in the present invention, a polymer component represented by the following formula (V) can be exemplified:

(V)

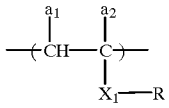

wherein $X_1$ represents —COO—, —OCO— or —O—; and R represents an alkyl or alkenyl group having from 10 to 32 carbon atoms, preferably an alkyl or alkenyl group having from 10 to 22 carbon atoms, each of which may be straight chain or branched, and an unsubstituted group is preferred, but may have a substituent.

Specific examples thereof include a decyl group, a dodecyl group, a tridecyl group, a tetradecyl group, a hexadecyl group, an octadecyl group, an eicosanyl group, a docosanyl group, a decenyl group, a dodecenyl group, a tridecenyl group, a hexadecenyl group, an octadecenyl group, and a linoleyl group.

$a_1$ and $a_2$, which may be the same or different, each preferably represents a hydrogen atom, a halogen atom (e.g., chlorine, bromine, etc.), a cyano group, an alkyl group having from 1 to 3 carbon atoms (e.g., methyl, ethyl, propyl, etc.), —COO—$Z^1$ or —$CH_2$COO—$Z^1$ (wherein $Z^1$ represents a hydrogen atom or a hydrocarbon group having 22 or less carbon atoms which may be substituted (e.g., alkyl, alkenyl, aralkyl, alicyclic, aryl, etc.)).

$Z^1$ specifically represents, besides a hydrogen atom, a hydrocarbon group, and examples of preferred hydrocarbon groups include an alkyl group having from 1 to 22 carbon atoms which may be substituted (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl, 3-bromopropyl, etc.), an alkenyl group having from 4 to 18 carbon atoms which may be substituted (e.g., 2-methyl-l-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, linoleyl, etc.), an aralkyl group having from 7 to 12 carbon atoms which may be substituted (e.g, benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl, etc.), an alicyclic group having from 5 to 8 carbon atoms which may be substituted (e.g, cyclohexyl, 2-cyclohexylethyl, 2-cyclopentylethyl, etc.), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, dodecyloylamidophenyl, etc.).

The disperse polymer may contain, with the repeating unit represented by formula (V), other repeating units as copolymer components Any compounds may be used as other repeating units so long as they comprise monomers which are copolymerizable with a monomer corresponding to the repeating unit represented by formula (V).

The ratio of the polymer component represented by formula (V) in the disperse polymer is preferably 50 wt % or more, more preferably 60 wt % or more.

As the specific example of the disperse polymer, a resin for dispersion stabilization (Q-1) used in the examples can be exemplified, and commercially available products can also be used (e.g., Solprene 1205, manufactured by Asahi Chemical Industry Co., Ltd.).

The disperse polymer is preferably added in advance to the resin particles for the polymerization for producing a latex.

The addition amount of the disperse polymer is preferably from 0.05 to 4 wt % or so based on the entire weight of the ink.

The dispersed resin particles and the colored particles (or coloring material particles) in the oil-based ink according to the present invention are preferably electroscopic particles having plus charge or minus charge For imparting electroscopicity to these particles, the techniques of liquid developers for electrostatic photographs can be employed. Specifically, these techniques can be effected by using the electroscopic materials and additives described in the above-described *Saikin no Denshi-shasbin Genzo System to Toner Zairyo no Kaihatsu•Jitsuoka* (*Recent Development Systems in Electrophotography and Development and Practical Uses of Toner Materials*, pp. 139 to 148, Denshishashin Gakkai compiled, *Denshishashin Gijutsu no Kiso to Oyo* (*The Fundamentals and Applications of Electrophotographic Techniques*), pp. 497 to 505, Corona Co. (1988), and Yuji Harasaki, *Denshishashin* (*Electrophotography*), 16, No. 2, p. 44 (1977).

Specific methods thereof are disclosed, e.g., in British Patents 893,429 and 934,038, U.S. Pat. Nos. 1,122,397, 3,900,412 and 4,606,989, and JP-A-60-179751, JP-A-60-185963 and JP-A-2-13965.

The charging adjustors as above are preferably added in an amount of from 0.001 to 1.0 weight part per 1,000 weight parts of a dispersion medium which is a liquid carrying the charging adjustors. Further, various additives may be added thereto, if necessary, and the upper limit of the total amount of these additives is restricted by the electric resistance of the oil-based ink to be used. That is, since when the electric resistance of the ink in the state exclusive of dispersion particles is lower than $10^9$ Ω·cm, an image of excellent continuous tone can be obtained with difficulty, it is necessary to control the addition amount of each additive within this range.

In the next place, a method of forming an image on the above-described lithographic printing plate precursor (hereinafter sometimes referred to as "master") by an ink jet system will be described below.

Any of conventionally well-known ink jet recording systems can be used for the image formation. However, the use of oil-based ink is preferred because it ensures quick drying and satisfactory fixation of the ink image and hardly causes clogging, and the adoption of an electrostatic ejection type ink jet recording system (or an electrostatic suction system), or a solid jet type ink jet recording system with hot-melt ink is preferably used because such a system hardly causes the blur of images.

For the electrostatic ejection type ink jet recording system, recording apparatus disclosed in WO 93/11866, WO 97/27058 and WO 97/27060 can be used. The oil-based ink to be used is preferably a dispersion comprising hydrophobic resin particles, which are solid at least at normal temperature (ie., from 15 to 35° C.), dispersed in a non-aqueous solvent preferably having an electric resistance of $10^9$ Ω·cm or more and a dielectric constant of 3.5 or less as a dispersion medium. By using such a non-aqueous solvent as a dispersion medium, the electric resistance of the oil-based ink is properly controlled, thus the ejection of the oil-based ink by the action of an electrical field can be effected, as a result the image quality is improved. In addition, the use of the above-described resins particles enhances the affinity with the image-receiving layer, as a result, high quality images can be obtained as well as the press life of the resulting printing plate is improved.

Specific examples of the oil-based ink are disclosed, e.g., in U.S. Pat. Nos. 6,143,806, 6,174,936, 6,184,267, 6,197,847 and 6,127,452; and in JP-A-10-204354 and JP-A-10-306244.4.

For the solid jet type ink jet recording system, commercially available printing systems such as Solid Inkjet Platemaker SJ02A (manufactured by Hitachi Koki Co., Ltd.) and MP-1200Pro (manufactured by Dynic Co., Ltd.) can be exemplified.

A method for forming images on the lithographic printing plate precursor according to the present invention using an ink jet recording system is described in more detail below with reference to the accompanying drawings.

An apparatus system shown in FIG. 1 comprises an ink jet recording apparatus 1 in which an oil-based ink is used.

As shown in FIG. 1, pattern information of images (figures and letters) to be formed on master 2 is first supplied from an information supply source such as computer 3 to ink jet recording apparatus 1 using oil-based ink via a transmission means such as bus 4. Head 10 for ink jet recording of recording apparatus 1 stores oil-based ink inside. When master 2 is passed through recording apparatus 1, head 10 ejects fine droplets of the ink onto master 2 in accordance with the foregoing information, thereby the ink is attached to master 2 in the foregoing pattern. Thus, the image formation on master 2 is completed and a printing plate master (lithographic printing plate master) is obtained.

Figure 2:
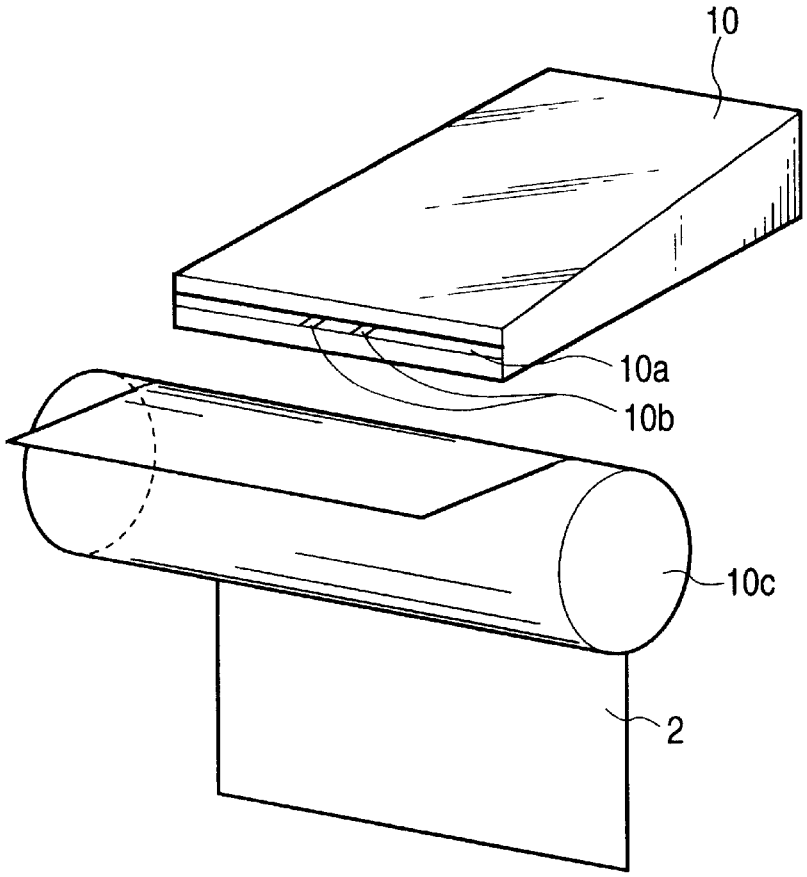
FIG. 2 is a schematic view showing the main part of an ink jet recording device for use in the present invention.
Figure 3:
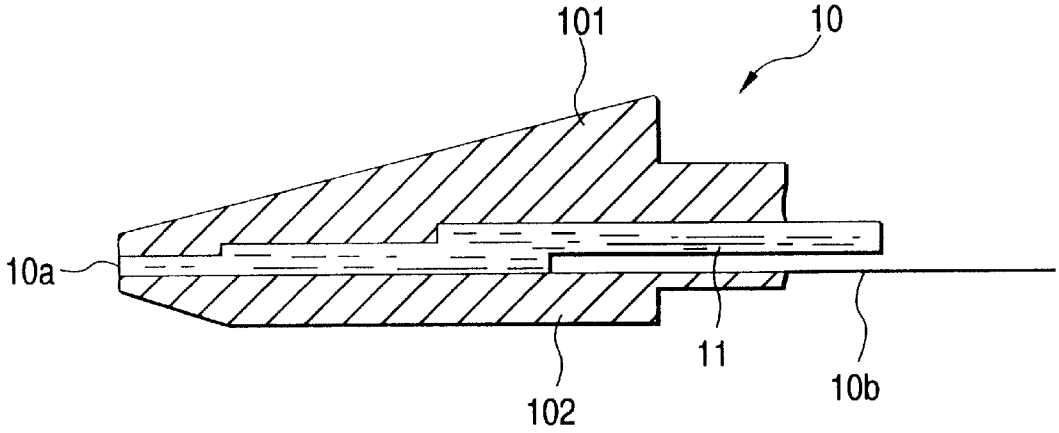
FIG. 3 is a partial cross-sectional view of the head of an ink jet recording device for use in the present invention.

Constitutional components of the ink jet recording apparatus as shown in the apparatus system of FIG. 1 are shown in FIGS. 2 and 3. In FIGS. 2 and 3, members common to those in FIG. 1 are shown using the same symbols.

FIG. 2 is a schematic view showing the main parts of the ink jet recording apparatus, and FIG. 3 is a partial cross sectional view of the head.

As shown in FIGS. 2 and 3, head 10 attached to the ink jet recording apparatus has a slit between upper unit 101 and lower unit 102, and the tip thereof forms ejection slit 10*a*.

Ejection electrode 10*b* is arranged in the slit, and the interior of the slit is filled with oil-based ink 11.

To ejection electrode 10*b* of head 10, voltage is applied in accordance with digital signals from the pattern information of the image. As shown in FIG. 2, counter electrode 10*c* is arranged so as to face to ejection electrode 10*b*, and master 2 is provided on counter electrode 10*c*. A circuit is formed between ejection electrode 10*b* and counter electrode 10*c* by the application of the voltage, and oil-based ink 11 is ejected from ejection slit 10*a* of head 10, thereby an image is formed on master 2 provided on counter electrode 10*c*.

With respect to the width of ejection electrode 10*b*, the tip thereof is preferably as narrow as possible in order to form images of high quality.

For example, print of 40 μm dot can be formed on master 2 by filling head 10 as shown in FIG. 3 with the oil-based ink, disposing ejection electrode 10*b* having a tip having a width of 20 μm and counter electrode 10*c* so as to face to each other at a distance of 1.5 mm and applying a voltage of 3 kV for 0.1 msec. between these two electrodes.

Figure 4:
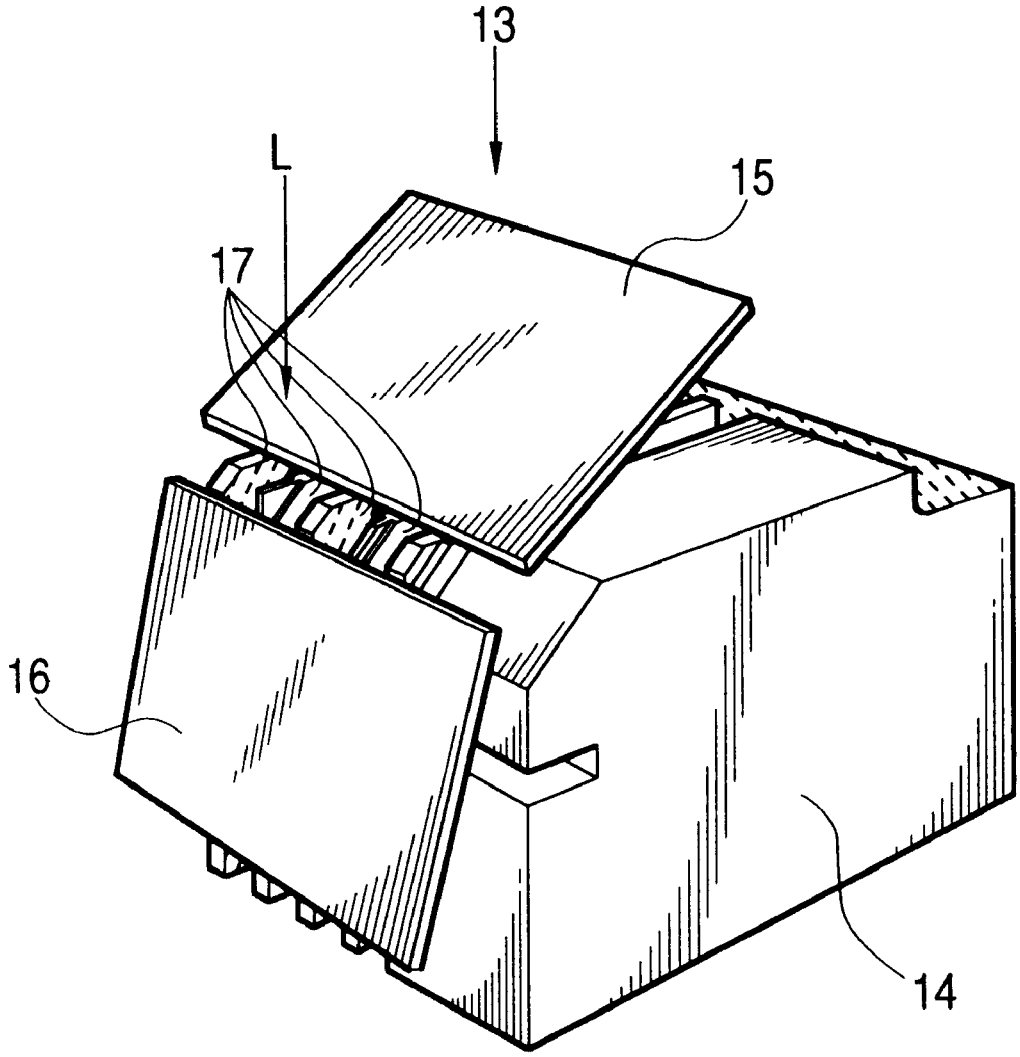
FIG. 4 is a schematic view showing the main part of a head of another ink jet recording device for use in the present invention.
Figure 5:
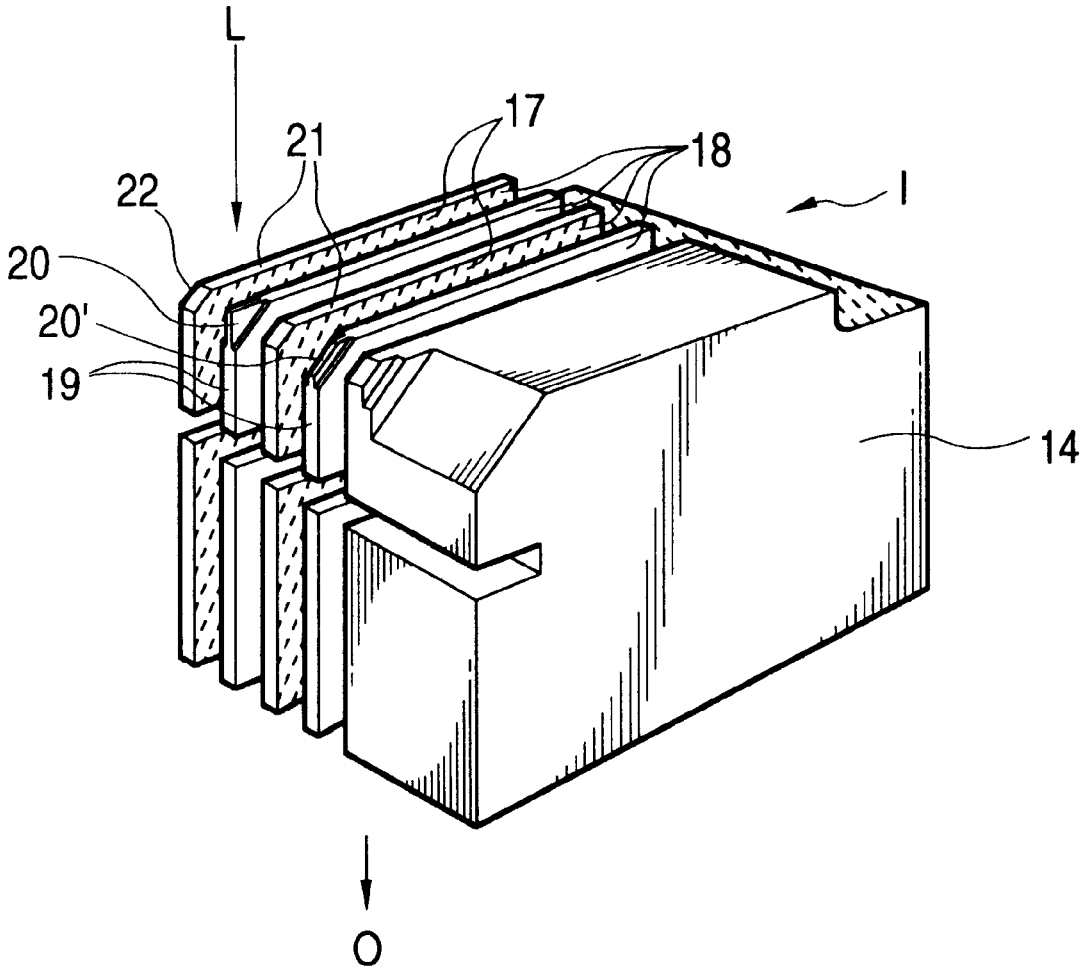
FIG. 5 is a schematic view explaining the head of the ink jet recording device shown in FIG. 4 for use in the examples.

Further, constitutional components of other ink jet recording apparatus which can be used in the present invention are shown in FIGS. 4 and 5.

FIG. 4 is a schematic view showing only a part of the heat for explanation. As shown in FIG. 4, head 13 for recording comprises head body 14 made of an insulating material such as plastics, ceramics or glass, and meniscus regulating plates 15 and 16. In FIGS. 4 and 5, 17 is the ejection electrode to apply voltage for forming an electrostatic field at the ejection part.

The head body is further described in detail by FIG. 5 in which meniscus regulating plates 15 and 16 are excluded from the head. A plurality of ink grooves 18 for circulating the ink are provided in head body 14 in vertical to the edge of head body 14. The shape of ink groove 18 should be sufficient if it is set in the range that capillary function is not hindered so as to form uniform ink flow, however, particularly preferably the width of ink groove 18 is from 10 to 200 μm and the depth is from 10 to 300 μm. Ejection electrode 17 is provided in the inside of ink groove 18. Ejection electrode 17 is formed of a conductive material, such as aluminum, nickel, chromium, gold or platinum, on head body 14 comprising an insulating material. Ejection electrode 17 is formed by well-known methods, as is the same in the case so the ink jet recording apparatus, and may be arranged entirely or partially in ink groove 18. Further, each ejection electrode is electrically independent.

Adjacent two ink grooves form one cell and ejection part 20, 20' are provided at the tip part of separator wall 19 positioned at the center of two ink grooves. Separator wall 19 at ejection part 20, 20' is thinner than other part of separator wall 19, i.e., tapered. The ejection part may be slightly chamfered such as ejection part 20'. The head body is produced by known methods, such as machining, etching or molding of insulating material blocks. The thickness of the separator wall at the ejection part is preferably from 5 to 100 μm, and the radius of curvature of the tapered tip part is preferably from 5 to 50 μm. Although only two cells are shown in FIG. 5, a cell is partitioned by separator wall 21 and the tip part 22 of separator wall 21 is chamfered so as to be recessed from ejection part 20, 20'. Ink is flowed through the ink groove from direction I by ink supply means which is not shown in FIG. 5 to the head to supply ink to the ejection part.

The surplus ink is reclaimed by ink reclaiming means not shown in FIG. 5 to the direction O, as a result, fresh ink is supplied to the ejection part any time In the state of irradiating the ink near the ejection part with light as L, counter electrode 17 retaining the recording medium on the surface, which is not shown in FIG. 5, is arranged so as to face to the ejection part. When voltage is applied to the ejection electrode in accordance with the signals from image information, the ink is ejected from ejection part 20, 20', thereby an image is formed on the recording medium on the surface of counter electrode 17.

The master after plate-making obtained by forming an image by the ink jet system using oil-based ink on the lithographic printing plate as described above is subjected to surface treatment with a desensitizing solution to desensitize the non-image area, to thereby prepare a printing plate.

EXAMPLES

The present invention will be described in detail below with the following examples, but the present invention is not limited thereto.

A preparation example of resin particles for oil-based ink (PL) is described below.

Preparation Example 1

Preparation of Resin Particles (PL-1)

A mixed solution containing 10 g of resin for dispersion stabilization (Q-1) having the composition shown below, 100 g of vinyl acetate and 384 g of Isopar H was heated to a temperature of 70° C. under nitrogen gas stream with stirring. As a polymerization initiator, 0.8 g of 2,2'-azobis (isovaleronitrile) (AIVN) was added thereto, and the mixture was allowed to react for 3 hours. Twenty minutes after the addition of the polymerization initiator, white turbidity was generated in the reaction mixture and the temperature had risen to 88° C. Further, 0.5 g of the same initiator was added to the reaction solution and the reaction was continued for 2 hours, then the temperature was raised to 100° C., followed by stirring for 2 hours, then unreacted vinyl acetate was removed by distillation. After cooling, the reaction mixture was passed through a nylon cloth of 200 mesh The resulting white dispersion was a highly monodispersed latex having a polymerization rate of 90% and an average particle diameter of 0.23 μm. The average particle diameter was measured by CAPA-500 (manufactured by Horiba Seisakusho Co., Ltd.).

Resin for Dispersion Stabilization (O-1)

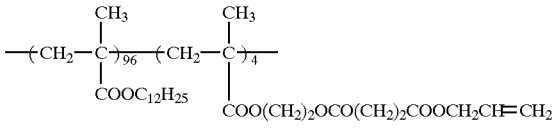

Mw: 5 x $10^4$ (weight ratio)

A part of the above white dispersion was centrifuged (rotation number: $1\times10^4$ rpm, rotation time: 60 minutes), and the precipitated resin particle content was collected and dried The resin particle content had a weight average molecular weight (Mw: GPC value calculated in terms of polystyrene) of $2\times10^5$, and a glass transition point (Tg) of 38° C.

Comparative Examples 1, 2 and 9, Examples 3 to 8

On high quality paper weighing 100 g/m$^2$ was coated a 5% aqueous solution of calcium chloride in an amount of 20 g/m$^2$ and dried, thereby conductive base paper was obtained. An aqueous latex of ethylene-methyl acrylate-acrylic acid copolymer (molar ratio: 65/30/5) was coated on both sides of the above base paper in a dry coating weight of 0.2 g/m$^2$ and dried. Thereafter, melted and kneaded pellets containing 70 wt % of low density polyethylene having a density of 0.920 g/ml and a melt index of 5.0 g/10 min, 1.5 wt % of high density polyethylene having a density of 0.950 g/ml and a melt index of 8.0 g/10 min, and 15 wt % of conductive carbon were laminated on one side of the base paper in a thickness of 25 $\mu$m by extrusion laminating method, thus a support of the present invention having a uniform polyethylene layer thickness was obtained. The thus-obtained support was designated water-resisting support 1.

The laminated side of water-resisting support 1 had a cup water absorption of 0.01 g/m$^2$(45 minute value) and a Bekk's smoothness of 350 sec/10 ml.

In the next place, each of the coating solutions A to G (shown in Table 1) for a conductive layer was coated on the side of the support on which the laminated layer was not provided by a wire bar in a dry coating weight of 10 g/m$^2$, and then the support was subjected to calendering treatment so as to reach the surface smoothness of the conductive layer of 1,500 (sec/10 ml).

Seven kinds of water-resisting support thus-prepared were designated support sample No. 01 to No 07 respectively corresponding to coating solution A to G as shown in Table 1.

Coating Solution for Conductive Layer

Carbon black (30% water dispersion solution)

Clay (50% water dispersion solution)

SBR latex (solid content: 50%, Tg: 25° C.)

Malamine resin (solid content: 80%, Sumilets Resin SR-613)

Each of the above components was mixed as shown in Table 1, and water was added so that the concentration of the entire solid content became 25%, thus coating solutions for conductive layers A to G were obtained.

TABLE 1

| Prescription | Carbon Black | Clay | SBR Latex | Melamina Resin | Support Sample No. |
|---|---|---|---|---|---|
| A | 0 | 60 | 36 | 4 | 01 |
| B | 3 | 57 | 36 | 4 | 02 |
| C | 5.4 | 54.6 | 36 | 4 | 03 |
| D | 7.2 | 52.8 | 36 | 4 | 04 |
| E | 9 | 51 | 36 | 4 | 05 |
| F | 15 | 45 | 36 | 4 | 06 |
| G | 30 | 30 | 36 | 4 | 07 |

The numerals in the table were the amount of the solid content of each component shown in wt %.

Specific Electric Resistance of Conductive Layer

The specific electric resistance of the conductive layer was measured as follows.

Each of the coating solutions for conductive layers A to G was coated on a stainless steel plate thoroughly washed and degreased and a layer having a dry weight of 10 g/m$^2$ was obtained. The specific electric resistance value of each sample was measured by a three terminal method with providing guard electrode according to the method described in JIS K-6911. The results obtained are shown in Table 2.

TABLE 2

| Prescription of Conductive Layer | Specific Electric Resistance Value |
|---|---|
| A | $2 \times 10^{12}$ |
| B | $4 \times 10^{11}$ |
| C | $4 \times 10^{8}$ |
| D | $4 \times 10^{8}$ |
| E | $7 \times 10^{4}$ |
| F | $5 \times 10^{3}$ |
| G | $4 \times 10^{3}$ |

Then, a coating solution for the interlayer having the following composition was coated on the same support with Sample No. 04 in a dry coating weight of 3 g/m$^2$. The resulting support sample was designated sample No. 8.

Coating Solution of Interlayer

| | |
|---|---|
| Kaolin (50% water dispersion solution) | 200 parts |
| Methanol silica (solid content: 20%) | 30 parts |
| Acryl latex (solid content: 50%, AE872 (manufactured by Nihon Gosei Gomu Co., Ltd.) | 100 parts |
| Aqueous solution of polyvinyl alcohol (10%) | 30 parts |
| Melamine resin (solid content: 80%, Sumilets Resin SR-613) | 5 parts |

An image-receiving layer was prepared by coating the dispersion solution having the composition shown below on each of support sample Nos. 01 to 08 in a dry coating weight of 6 g/m$^2$.

Coating Solution for Image-Receiving Layer

A mixture containing 100 g of dry zinc oxide, 3.0 g of the hinder resin (B-1) having the following composition, 17.0 q of the binder resin (B-2) having the following composition, 0.15 g of benzoic acid, and 155 g of toluene was dispersed with a wet homogenizer (manufactured by Nihon Seiki Co., Ltd.) at 6×10$^3$ rpm for 3 minutes.

Binder Resin (B-1)

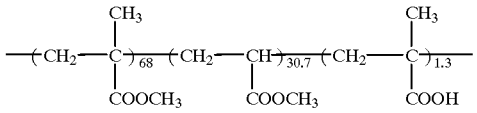

Mw 9 x 10$^3$

Binder Resin (B-2)

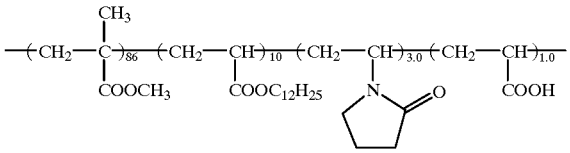

Mw: 4 x 10$^4$ (weight ratio)

The above conductive layer coating solution D was coated on both ends of each of sample Nos. 01 to 08 in a dry thickness of 1 $\mu$m, and the resulting samples were designated lithographic printing plate precursor sample Nos. 1 to 8, and sample No. 08 on which a conductive layer was not provided was designated lithographic printing plate precursor sample No. 9.

Plate-making was performed using the above-prepared lithographic printing plate precursor sample Nos. 1 to 9.

Servo PlotterDA8400 (manufactured by Graphtec Corp.) capable of imaging an output from a personal computer was converted to so that an ink ejection head as shown in FIG. 2 was loaded on a pen plotter section, and the lithographic printing plate precursor prepared above was placed on a counter electrode positioned at a distance of 1.5 mm from the ink ejection head Printing was performed on the lithographic printing plate precursor using oil-based ink (IK-1) having the composition shown below to effect plate-making.

Preparation of Oil-based ink (TK-1)

Ten (10) grams of dodecyl methacrylate/acrylic acid copolymer (copolymerization ratio: 95/5 by weight), 10 g of nigrosine, and 30 g of Shell Sol 71 were put in a paint shaker (manufactured by Toyo Seiki Co., Ltd.) together with glass beads and dispersed for 4 hours, thus a fine particle dispersion of nigrosine was obtained.

Six (6) grams (as solid content) of resin particles (PL-1) prepared in the above Preparation Example 1 of resin particles for oil-based ink, 2.5 g of the above nigrosine dispersion, 15 g of FOC-1400 (tetradecyl alcohol, manufactured by Nissan Chemical Industries, Ltd.), and 0.08 g of octadecene-semi-maleic acid octadecylamide copolymer were diluted with 1 liter of Isopar, thus black oil-based ink (IK-1) was obtained After each of lithographic printing plate precursor samples had been subjected to plate-making, each sample was subjected to printing using a full automatic printer (AM-2850, manufactured by AM Co., Ltd.). A desensitizing solution (ELP-E2, manufactured by Fuji Photo Film Co., Ltd.) was put in the etcher part of the printer arid, as a dampening solution, a desensitizing solution (SICS) diluted 4 times with distilled water was put in a dampening saucer, a black ink for offset printing was used as the ink, and printing was performed through the above lithographic printing plate precursors.

Each image quality of the image formed on the printing plate precursor sample was evaluated as follows. The results obtained are shown in Table 3.

TABLE 3

| Sample No. of Plate | Inter-layer | Con-ductive Layer at Both Ends | Image Quality of Plate-Making | Image Quality of Print | Press Life at Printing | Dimen-sional Stability |
|---|---|---|---|---|---|---|
| 1 | Absent | Present | x | x | 50 | 0.1 mm |
| 2 | Absent | Present | x | x | 100 | 0.1 mm |
| 3 | Absent | Present | o | o | 3,000 | 0.1 mm |
| 4 | Absent | Present | ◎ | ◎ | 9,000 | 0.11 mm |
| 5 | Absent | Present | ◎ | ◎ | 9,000 | 0.11 mm |
| 6 | Absent | Present | ◎ | ◎ | 9,000 | 0.11 mm |
| 7 | Absent | Present | ◎ | ◎ | 9,000 | 0.12 mm |
| 8 | Present | Present | ◎ | ◎ | 9,000 | 0.12 mm |
| 9 | Present | Absent | Δ | Δ | 200 | 0.11 mm |

1) Plate-Making Property

The image on the printing plate precursor was observed with an optical microscope by 200 magnification. Evaluation was represented by ◎, o, Δ and x.

◎: There was no problem with the drawing image and fine lines and fine letters were very excellent.

o: There was no problem with the drawing image and fine lines and fine letters were good.

Δ: Disappearance and blur were slightly observed in fine lines and fine letters, not good.

x: Disappearance and blur were observed in fine lines and fine letters, not good.

2) Image Quality of Printed Matter

The images of the obtained printed matters were evaluated in the same manner as above.

3) Dimensional stability

The distortion of the printing plate (dimensional stability) during printing was observed. Printing was performed using Oliver 52 of Kiku-4 size (manufactured by Sakurai Co., Ltd.) at a printing speed of 8,000/min and 5,000 sheets were printed. Dimensional stability was evaluated by the dislocation of the registers of the prints from the beginning of printing until 5,000 sheets were printed (the position of register-register was 300 mm in the printing direction). The smaller the dislocation, the better is the dimensional stability.

4) Press Life

The number of prints until background stain or disappearance of image could he visually observed for the first time was determined.

The results in Table 3 are considered with reference to the specific electric resistance value in Table 2.

In printing plate precursor sample Nos. 1 and 2 both of which showed a large specific electric resistance value, i e., from $10^{12}$ to $10^{11}$ Ω·cm, image disappearance and blur were generated, and the press life was low due to thinning of the drawn image as a result of blurring. On the other hand, printing plate precursor sample Nos. 4 to 8 having a small specific electric resistance value, e.g., i.e., from $10^{8}$ to $10^{3}$ Ω·cm, exhibited good image quality, and fine lines and fine letters were refined as well as the dimensional stability and the press life of each sample were improved. With printing plate precursor sample No. 9 having no conductive layer on its ends, image disappearance and blur were slightly observed and the resulting printing plate could not be practically used. In addition, the press life was poor. The printing plate precursor sample No. 9 provided good results, only when it was electrically connected with the counter electrode using silver paste at the plate-making.

Examples 10 to 12

Preparation of Printing Plate Material Sample Nos. 10 to 12

Lithographic printing plate precursor sample Nos. 10 to 12 were prepared in the same manner as in the preparation of sample No. 7 except that each of the following dispersion solutions for an image-receiving layer was coated on a support with a wire bar in a dry coating weight of 5 g/m$^2$, dried in an oven at 100° C. for 10 minutes.

Preparation of Dispersion Solution for Image-Receiving Layer of Printing Plate Precursor Sample No. 10

One hundred (100) grams of zinc oxide FINEX-50 (ionic bonding rate: 0.59, manufactured by Sakai Chemical Industry Co., Ltd.), 113 g of a 10 wt % aqueous solution of polyvinyl alcohol PVA117 (manufactured by Kurare Co., Ltd.), and 240 g of water were put in a pain shaker (manufactured by Toyo Seiki Co., Ltd.) together with glass beads and dispersed for 30 minutes Further, 110 g of a 20 wt % solution of tetraethoxysilane which had been previously hydrolyzed (the ratio of water/ethanol was 1/1 by weight), and 200 g of colloidal silica Snowtex R503 (a 20 wt % aqueous dispersion solution, manufactured by Nissan Chemical Industries, Ltd.) were added thereto and dispersed for 3 minutes. Thereafter, the glass beads were removed by filtration to obtain a dispersion.

Preparation of Dispersion Solution for Image-Receiving Layer of Printing Plate Precursor Sample No. 11

A dispersion was prepared in the same manner as in sample No. 10 above except for using barium titanate in place of zinc oxide FINEX-50 in the image-receiving layer of the printing plate precursor of sample No. 10.

Preparation of Dispersion Solution for Image-Receiving Layer of Printing Plate Precursor Sample No. 12

A dispersion was prepared in the same manner as in sample No. 10 above except for using magnesium oxide hydrate in place of zinc oxide FINEX-50 in the image-receiving layer of the printing plate precursor of sample No 10.

Bekk's smoothness of each of the above-obtained printing plate precursor samples was from 300 to 400 (sec/10 ml).

The thus-obtained sample Nos 10 to 12 were subjected to plate-making in the same manner as in sample No. 7 in Example 7. Printing was performed by a molten type Ryobi 3200MCD printer (manufactured by Ryobi Co., Ltd.), and EV-3 (manufactured by Fuji Photo Film Co., Ltd.) diluted 100 times with distilled water was used as a dampening solution. As shown in Table 4, all of the samples provided good image qualities of the images formed on the printing plate precursors and images of the prints, and each sample showed good press life of 8,500 sheets or more.

TABLE 4

| Sample No. of Plate | Inter-layer | Con-ductive Layer at Both Ends | Image Quality of Plate-Making | Image Quality of Print | Press Life at Printing | Dimen-sional Stability |
|---|---|---|---|---|---|---|
| 10 | Present | Present | ◎ | ◎ | 8,500 | 0.12 mm |
| 11 | Present | Present | ◎ | ◎ | 9,000 | 0.11 mm |
| 12 | Present | Present | ◎ | ◎ | 12,000 | 0.10 mm |

Examples 13 to 15

Lithographic printing plate precursors were prepared in the same manner as in Examples 6 to 8 except for changing the conductive layers of sample Nos. 6, 7 and 8 coated on both ends to one end.

Each of the thus-obtained samples was subjected to plate-making in the same manner as in Example 6, 7 or 8. Printing was performed by a molten type Ryobi 3200MCD printer (manufactured by Ryobi Co., Ltd.), and EU-3 (manufactured by Fuji Photo Film Co., Ltd.) diluted 50 times with distilled water was used as a dampening solution. As shown in Table 5, all of the samples provided good image qualities of the images formed on the printing plate precursors and images of the prints, and each sample showed good press life of 8,700 sheets or more.

TABLE 5

| Sample No. of Plate | Inter-layer | Con-ductive Layer at One Ends | Image Quality of Plate-Making | Image Quality of Print | Press Life at Printing | Dimen-sional Stability |
|---|---|---|---|---|---|---|
| 13 | Absent | Present | ◎ | ◎ | 8,700 | 0.11 mm |
| 14 | Absent | Present | ◎ | ◎ | 9,000 | 0.11 mm |
| 15 | Present | Present | ◎ | ◎ | 8,900 | 0.11 mm |

Examples 16 to 78

Lithographic printing plate precursors were prepared in the same manner as in the preparation of printing plate material sample No. 10 in Example 10 except for using each compound shown in Tables A, B, C and C below in place of 100 g of zinc oxide FINEX-50. Bekk's smoothness of each of the above-obtained samples was from 250 to 300 (sec/10 ml).

Each printing plate precursor sample was subjected to plate-making and printing in the same manner as in Example 10. Printed matters having clear image free from background stain in the non-image area, and free from blur in the fine lines and the fine letters were obtained with each printing plate. The dimensional stability was as good as 0.12 mm or less with each sample.

The results of the press life of these samples are shown in Tables A, B, C and D. Each sample showed good press life of 7,000 sheets or more.

TABLE A

| Example No. | Metallic Oxide | Press Life |
|---|---|---|
| 16 | Magnesium oxide | 7,000 |
| 17 | Barium oxide | 7,000 |
| 18 | Chromic oxide | 9,000 |
| 19 | Cobalt (III) oxide | 9,000 |
| 20 | Zirconium oxide | 10,000 |
| 21 | Stannic oxide | 9,000 |
| 22 | Nickel oxide | 10,000 |
| 23 | Molybdenum trioxide | 8,000 |
| 24 | Tungsten dioxide | 10,000 |
| 25 | Tungsten trioxide | 10,000 |
| 26 | Cuprous oxide | 10,000 |
| 27 | Lead dioxide | 9,000 |
| 28 | Trilead tetroxide | 9,000 |
| 29 | Vanadium dioxide | 8,000 |
| 30 | Manganous oxide | 8,000 |
| 31 | Lanthanum oxide | 7,000 |
| 32 | Germanic oxide | 7,000 |

TABLE B

| Example No. | Metallic Oxide Hydrate | Press Life |
|---|---|---|
| 33 | Manganese oxide hydrate | 7,000 |
| 34 | Zinc oxide hydrate | 10,000 |
| 35 | Cobalt oxide hydrate | 7,000 |
| 36 | Zirconium oxide hydrate | 10,000 |
| 37 | Tin oxide hydrate | 9,000 |
| 38 | Cadmium oxide hydrate | 8,000 |
| 39 | Chromium oxide hydrate | 8,000 |
| 40 | Gallium oxide hydrate | 7,000 |
| 41 | Vanadium oxide hydrate | 7,000 |
| 42 | Nickel oxide hydrate | 10,000 |
| 43 | Copper oxide hydrate | 7,000 |
| 44 | Germanium oxide hydrate | 7,500 |
| 45 | Lead oxide hydrate | 9,000 |
| 46 | Palladium oxide hydrate | 7,000 |
| 47 | Cerium oxide hydrate | 7,000 |
| 48 | Molybdenum oxide hydrate | 9,000 |
| 49 | Lanthanum oxide hydrate | 7,500 |
| 50 | Titanium oxide hydrate | 9,000 |

TABLE C

| Example No. | Double Oxide | Press life |
|---|---|---|
| 51 | Magnesium silicate ($MgSiO_3$) | 7,500 |
| 52 | Cobalt silicate ($CoSiO_4$) | 7,000 |
| 53 | Strontium titanate ($SrTiO_3$) | 10,000 |
| 54 | Zirconium titanate ($ZrO_2TiO_2$) | 8,000 |
| 55 | Zinc titanate ($ZnTiO_3$) | 10,000 |
| 56 | Barium zirconate ($BaZrO_3$) | 10,000 |
| 57 | Lead stannate ($PbSnO_3$) | 9,000 |
| 58 | Magnesium tungstate ($MgWO_4$) | 7,000 |
| 59 | Strontium vanadate ($SrV_2O_6$) | 8,000 |
| 60 | Lead chromate ($PbCrO_4$) | 7,000 |
| 61 | Basic lead chromate ($PbCrO_4.PbO$) | 8,000 |
| 62 | Strontium molybdate ($SrMoO_4$) | 7,000 |
| 63 | Nickel titanate ($NiTiO_3$) | 7,000 |

TABLE C-continued

| Example No. | Double Oxide | Press life |
|---|---|---|
| 64 | Aluminum tungstate ($Al_2(WO_4)_3$) | 7,000 |
| 65 | Zinc silicate ($ZnO.SiO_2$) | 7,000 |
| 66 | Lead zirconate ($PbO.ZrO_2$) | 9,000 |
| 67 | Aluminum bolybdate ($Al_2(MoO_4)_3$) | 8,000 |
| 68 | Calcium circonate ($CaZrO_3$) | 10,000 |

TABLE D

| Example No. | Hydroxide Compound | Press Life |
|---|---|---|
| 69 | Magnesium hydroxide | 7,000 |
| 70 | Barium hydroxide | 7,500 |
| 71 | Aluminum hydroxide | 8,000 |
| 72 | Zinc hydroxide | 10,000 |
| 73 | Cobaltous hydroxide | 9,000 |
| 74 | Cupric hydroxide | 8,000 |
| 75 | Nickel hydroxide | 10,000 |
| 76 | Germanium hydroxide | 10,000 |
| 77 | Tin hydroxide | 8,000 |
| 78 | Lanthanum hydroxide | 7,000 |

The results in Tables A to D show that the higher the conductivity of the conductive layer of the support under the image-receiving layer and the conductivity at both ends of the printing plate, the more excellent are the image qualities of the printing plate and the printed matters.

According to the present invention, a printed matter having a clear image can be obtained and a printing plate excellent in press life can be produced.

While the invention has been described in detail and with reference to specific examples thereof, it will be apparent to one skilled in the art that various changes and modifications can be made therein without departing from the spirit and scope thereof.

What is claimed is:

1. A direct drawing lithographic printing plate precursor, which comprises a water-resisting support having provided thereon an image-receiving layer, an image being to be formed on the image-receiving layer with an oil-based ink by an electrostatic ink jet system, wherein said water-resisting support has at least a resin coating layer on the side opposite to the side on which the image-receiving layer is provided, wherein said resin coating layer comprises a mixture containing from 10 to 90 wt % of a low density polyethylene having a density of from 0.915 to 0.930 g/ml and a melt index of from 1.0 to 30.0 g/10 min., and from 10 to 90 wt % of a high density polyethylene having a density of from 0.940 to 0.970 g/ml and a melt index of from 1.0 to 30.0 g/10 min., wherein the surface of said resin coating layer has a Bekk's smoothness of from 5 to 2,000 sec/10 ml, and wherein said water-resisting support has a conductive layer having a specific electric resistance value of $10^{10}$ Ω·cm or less on the image-receiving layer side surface thereof and on at least one end face thereof.

2. The direct drawing lithographic printing plate precursor as claimed in claim 1, wherein said image-receiving layer is formed from a dispersion comprising:

an inorganic pigment comprising silica particles having an average particle diameter of from 1 to 6 μm and ultra-fine particles of inorganic pigment having an average particle diameter of from 5 to 50 nm, at a weight ratio of from 40/60 to 70/30; and at least one hydrophilic resin modified with a silyl functional group represented by the following formula (I):

$$—Si(R)_n(OX)_{3-n} \quad (I)$$

wherein R represents a hydrogen atom or a hydrocarbon group having from 1 to 12 carbon atoms; X represents an aliphatic group having from 1 to 12 carbon atoms; and n represents 0, 1 or 2.

3. The direct drawing lithographic printing plate precursor as claimed in claim 2, wherein said dispersion further contains gelatin and a gelatin-hardening compound.

4. The direct drawing lithographic printing plate precursor as claimed in claim 3, wherein the gelatin-hardening compound is a compound having in its molecule at least two double bond groups represented by the following formula (II):

$$CH_2=CH—W— \quad (II)$$

wherein W represents $—OSO_2—$, $—SO_2—$, $—CONR^1—$ or $—SO_2NR^1—$ (wherein $R^1$ represents a hydrogen atom or an aliphatic group having from 1 to 8 carbon atoms).

5. The direct drawing lithographic printing plate precursor as claimed in claim 2, wherein the ultrafine particles of inorganic pigment having an average particle diameter of from 5 to 50 nm comprise at least one member selected from colloidal silica, titania sol and alumina sol.

6. The direct drawing lithographic printing plate precursor as claimed in claim 1, wherein said image-receiving layer contains:

at least one kind of particles having an average particle diameter of from 0.01 to 5 μm and comprising atoms having interatomic ionic bonding rate of Pauling of the compound of 0.2 or more, which particle being selected from hydrous metallic compounds, metallic oxides and double oxides; and a binder resin containing a complex comprising: a resin hanging a siloxane bond connected with Si via an oxygen atom; and an organic polymer containing a group capable of bonding with said resin via a hydrogen bonding.

7. The direct drawing lithographic printing plate precursor as claimed in claim 6, wherein said resin containing siloxane bond is a polymer obtained by hydrolysis polycondensation of at least one silane compound represented by the following formula (III):

$$(R^0)_mSi(Y)_{4-m} \quad (III)$$

wherein $R^0$ represents a hydrogen atom, a hydrocarbon group or a heterocyclic group; Y represents a hydrogen atom, a halogen atom, $—OR^2$, $—OCOR^3$, or $—N(R^4)(R^5)$ (wherein $R^2$ and $R^3$ each represents a hydrocarbon group, and $R^4$ and $R^5$, which may be the same or different, each represents a hydrogen atom or a hydrocarbon group); and m represents 0, 1 or 2, provided that the case in which Si atom is bonded to three hydrogen atoms is excluded.

8. The direct drawing lithographic printing plate precursor as claimed in claim 1, wherein said image-receiving layer has surface smoothness of 30 sec/10 ml or more in terms of Bekk's smoothness.

9. A method for preparing a direct drawing lithographic printing plate, which comprises:

ejecting an oil-based ink by an electrostatic ink jet recording system onto an image-receiving layer of a direct drawing lithographic printing plate precursor as claimed in claim 1 to form an image thereon, wherein said oil-based ink is a dispersion comprising:

a non-aqueous solvent having an electric resistance of $10^9$ Ω·cm or more and a dielectric constant of 3.5 or less as a dispersion medium; and hydrophobic charged resin particles, which are solid at least at room temperature, dispersed in the non-aqueous solvent.

* * * * *